US007827941B2

(12) United States Patent
Sumi

(10) Patent No.: US 7,827,941 B2
(45) Date of Patent: Nov. 9, 2010

(54) BOILER

(75) Inventor: Soji Sumi, Matsuyama (JP)

(73) Assignee: Miura Co., Ltd., Ehime-Ken (JP)

( * ) Notice: Subject to any disclaimer, the term of this patent is extended or adjusted under 35 U.S.C. 154(b) by 344 days.

(21) Appl. No.: 11/984,406

(22) Filed: Nov. 16, 2007

(65) Prior Publication Data

US 2008/0127910 A1 Jun. 5, 2008

(30) Foreign Application Priority Data

Nov. 30, 2006 (JP) ..... 2006-323144

(51) Int. Cl.
*F22B 21/06* (2006.01)

(52) U.S. Cl. ..... 122/235.11; 122/6 A

(58) Field of Classification Search ..... 122/6 A, 122/1 B, 235.11, 235.23
See application file for complete search history.

(56) References Cited

U.S. PATENT DOCUMENTS 2,298,857 A * 10/1942 Clark ..... 110/323
3,633,550 A * 1/1972 Kraus ..... 122/235.11
4,257,358 A * 3/1981 Watanabe ..... 122/235.11
4,453,496 A * 6/1984 Yoshinari ..... 122/6 A
4,471,725 A * 9/1984 Holden ..... 122/379
5,199,384 A * 4/1993 Kayahara et al. ..... 122/18.4
5,273,001 A * 12/1993 Kayahara et al. ..... 122/138
6,116,196 A * 9/2000 Watanabe et al. ..... 122/235.11
6,253,715 B1 * 7/2001 Takubo et al. ..... 122/235.11
6,318,305 B1 * 11/2001 Takubo et al. ..... 122/235.11
6,823,821 B2 * 11/2004 Kayahara et al. ..... 122/367.1

FOREIGN PATENT DOCUMENTS

JP 2-75805 A 3/1990
JP 10-220701 A 8/1998

* cited by examiner

*Primary Examiner*—Gregory A Wilson
(74) *Attorney, Agent, or Firm*—Birch, Stewart, Kolasch & Birch, LLP

(57) ABSTRACT

To provide a boiler equipped with a water tube group performing heat recovery effectively and having expansion heating surfaces (fins or the like) of high durability, the present invention provides a boiler (1) including: a boiler body (10) having an inner water tube group (20) and an outer water tube group (30) that are arranged in an annular fashion; and a burner (40) arranged at a central portion of the inner water tube group (20), in which: intervals between adjacent inner water tubes constituting the inner water tube group (20) are closed except for portions where a gas flow passage is provided; and stud fins (22 and 32) are provided on a portion of at least one of the inner water tube group (20) and the outer water tube group (30) in a vicinity of the gas flow passage.

6 Claims, 19 Drawing Sheets

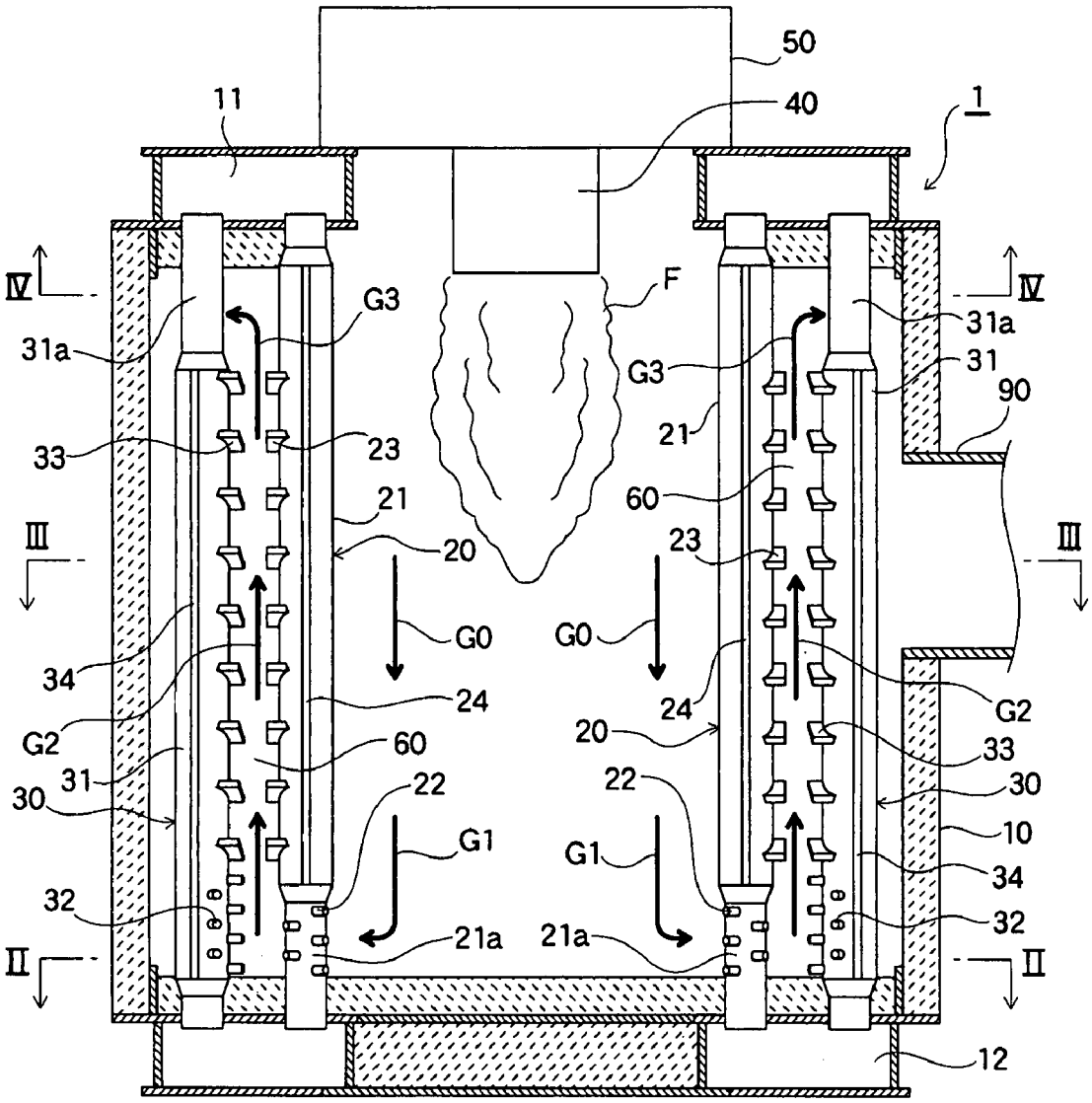
【FIG. 1】

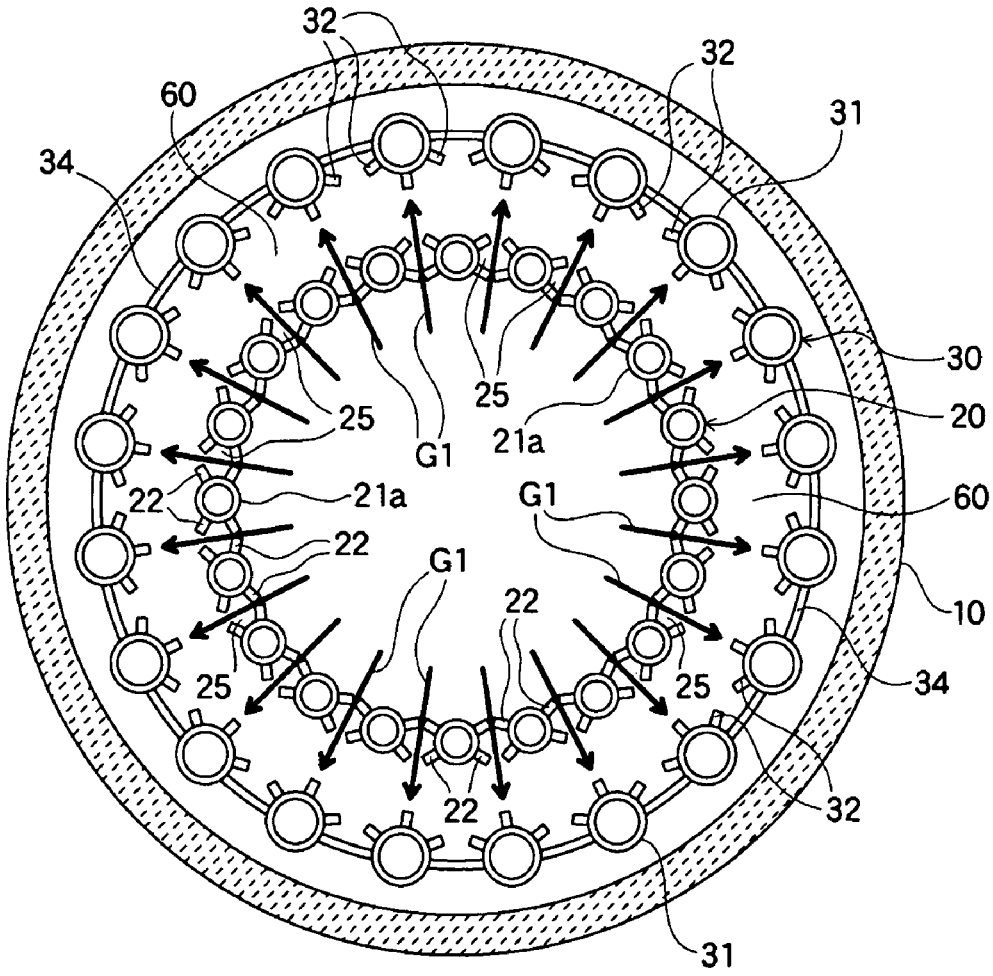
【FIG. 2】

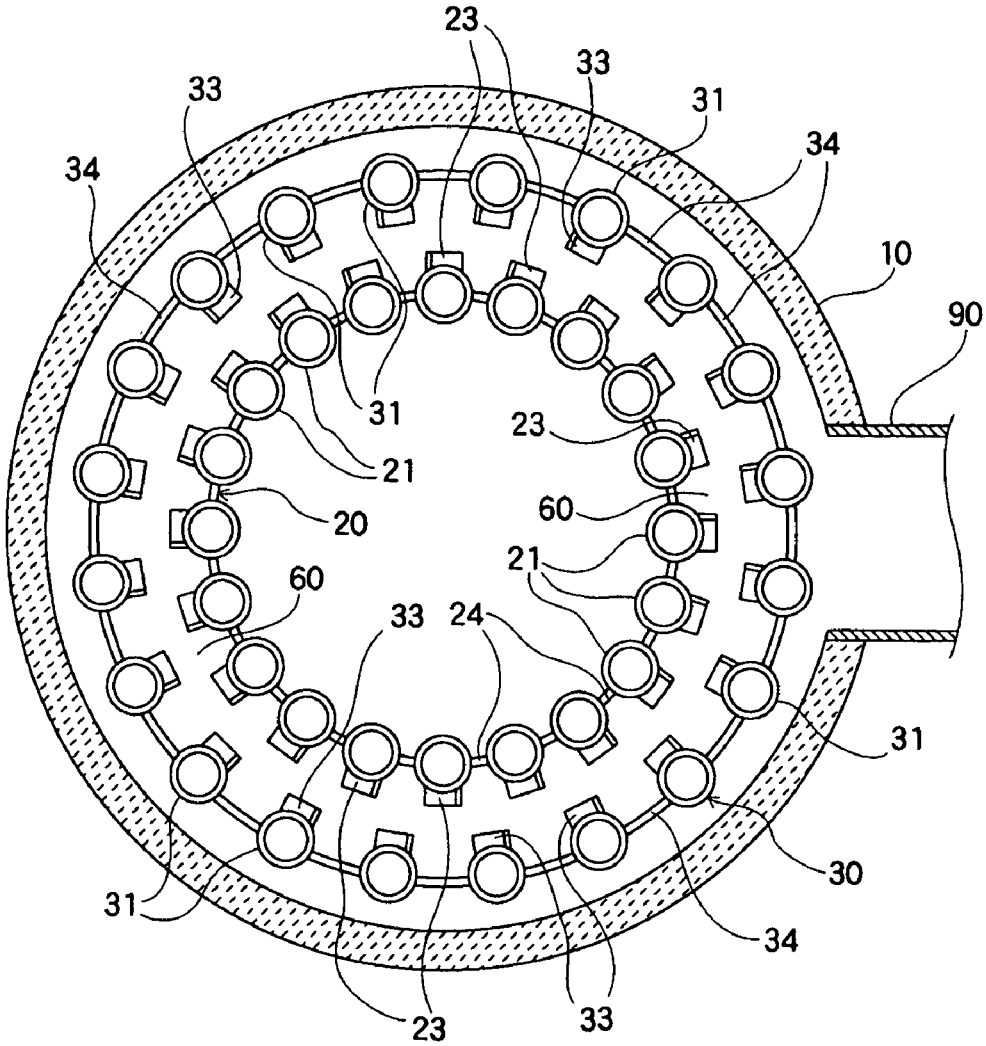
【FIG. 3】

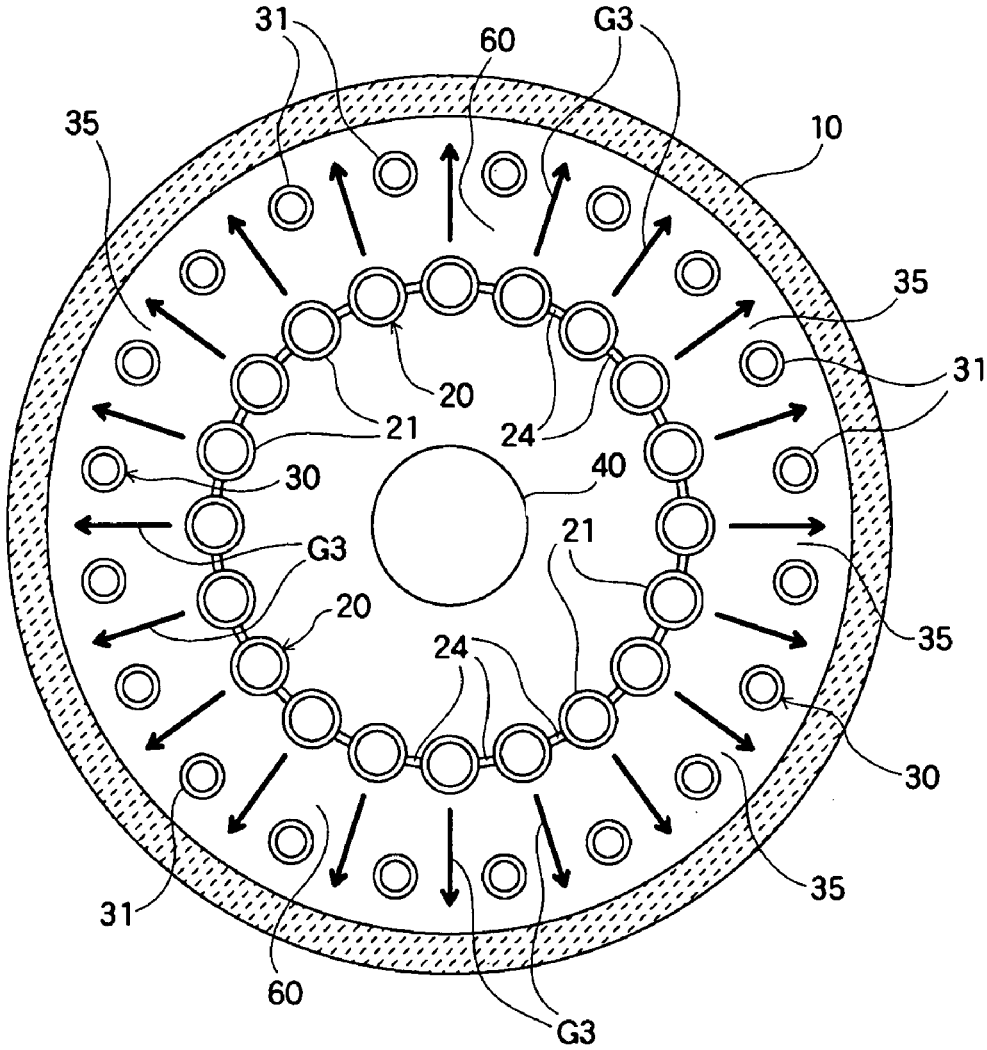
【FIG. 4】

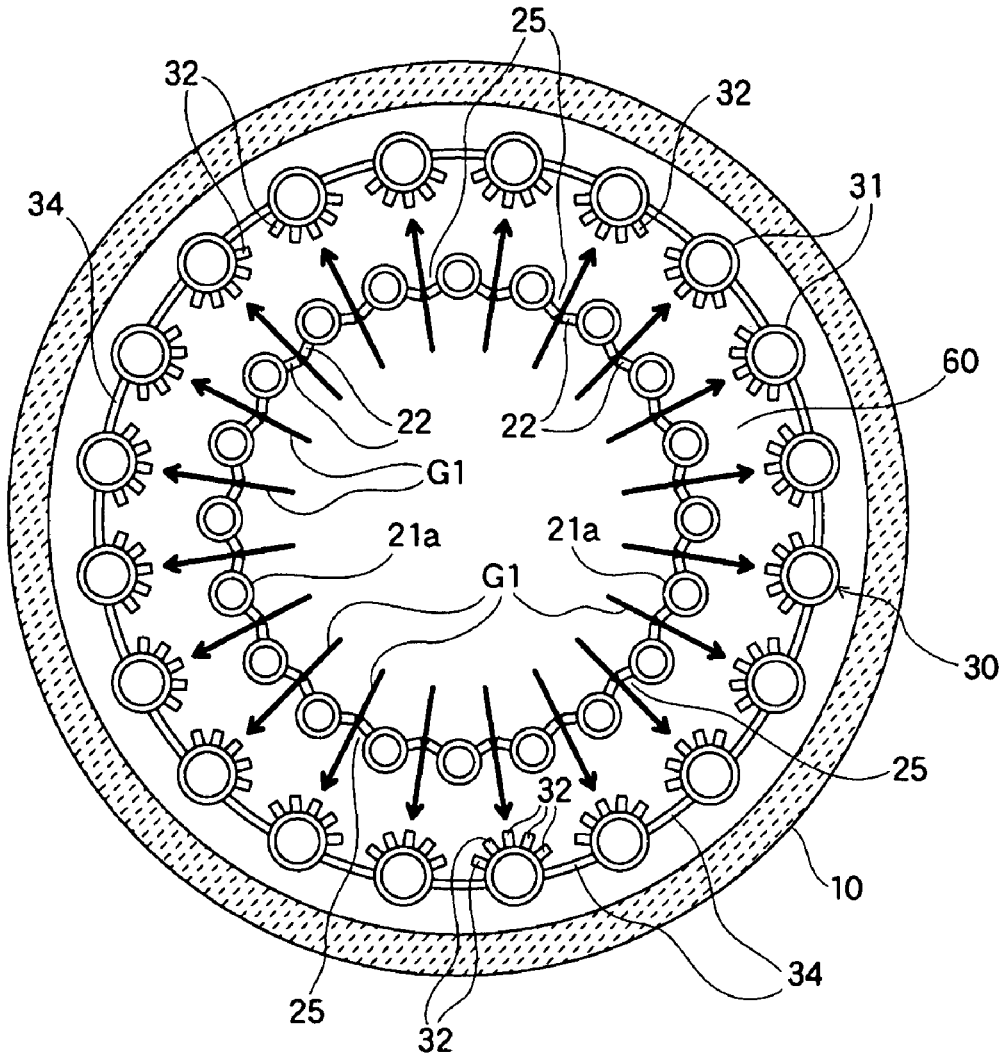
【FIG. 5】

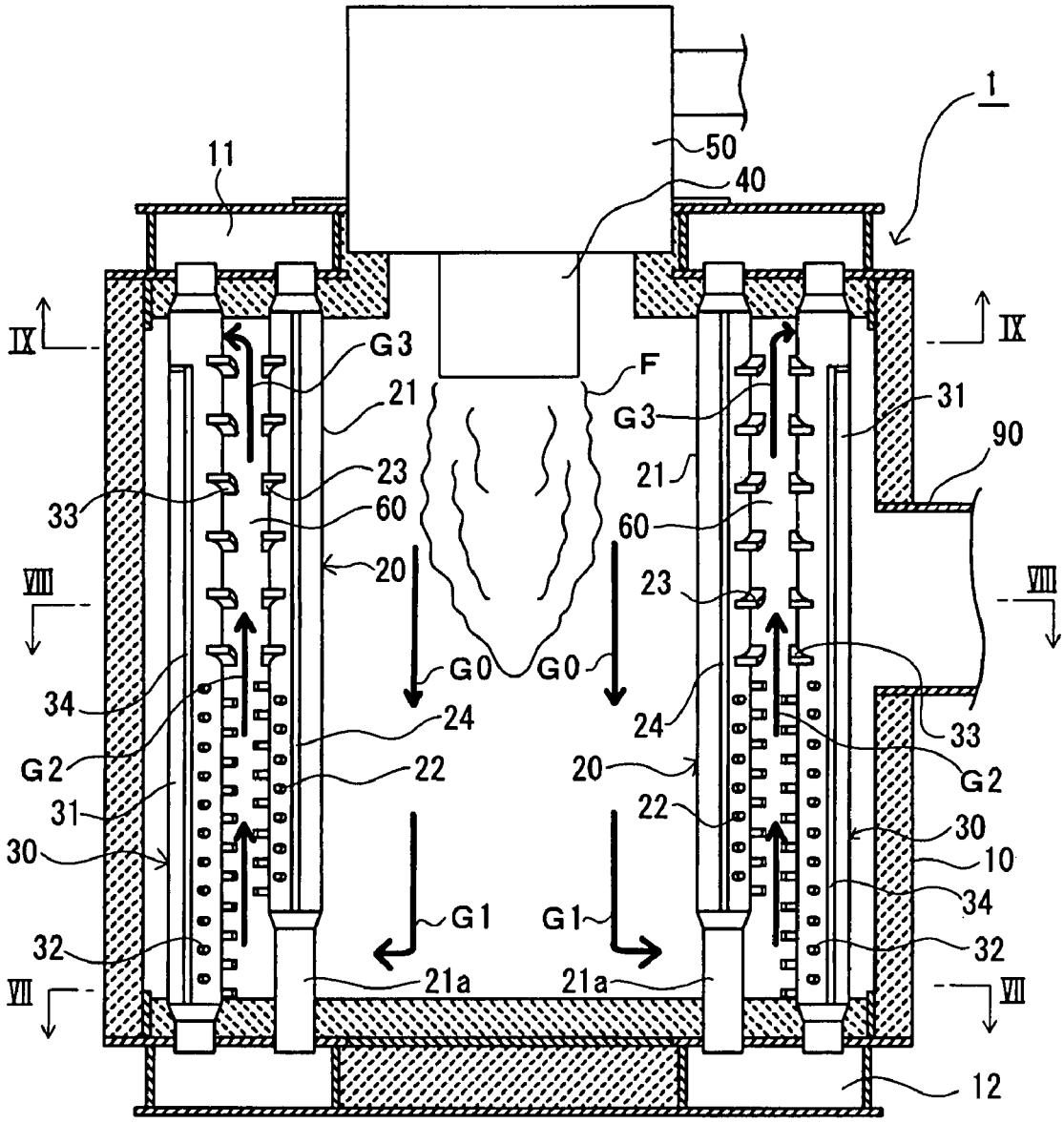
【FIG. 6】

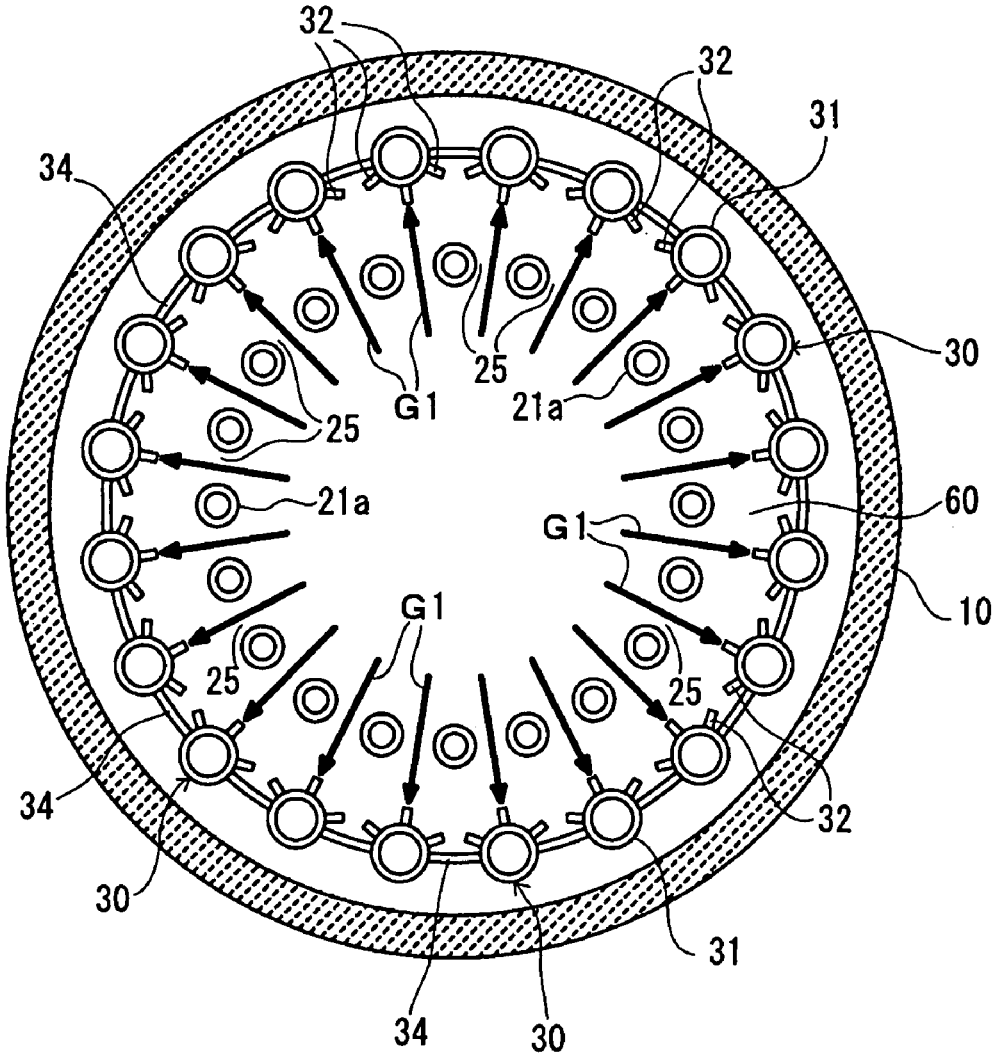
【FIG. 7】

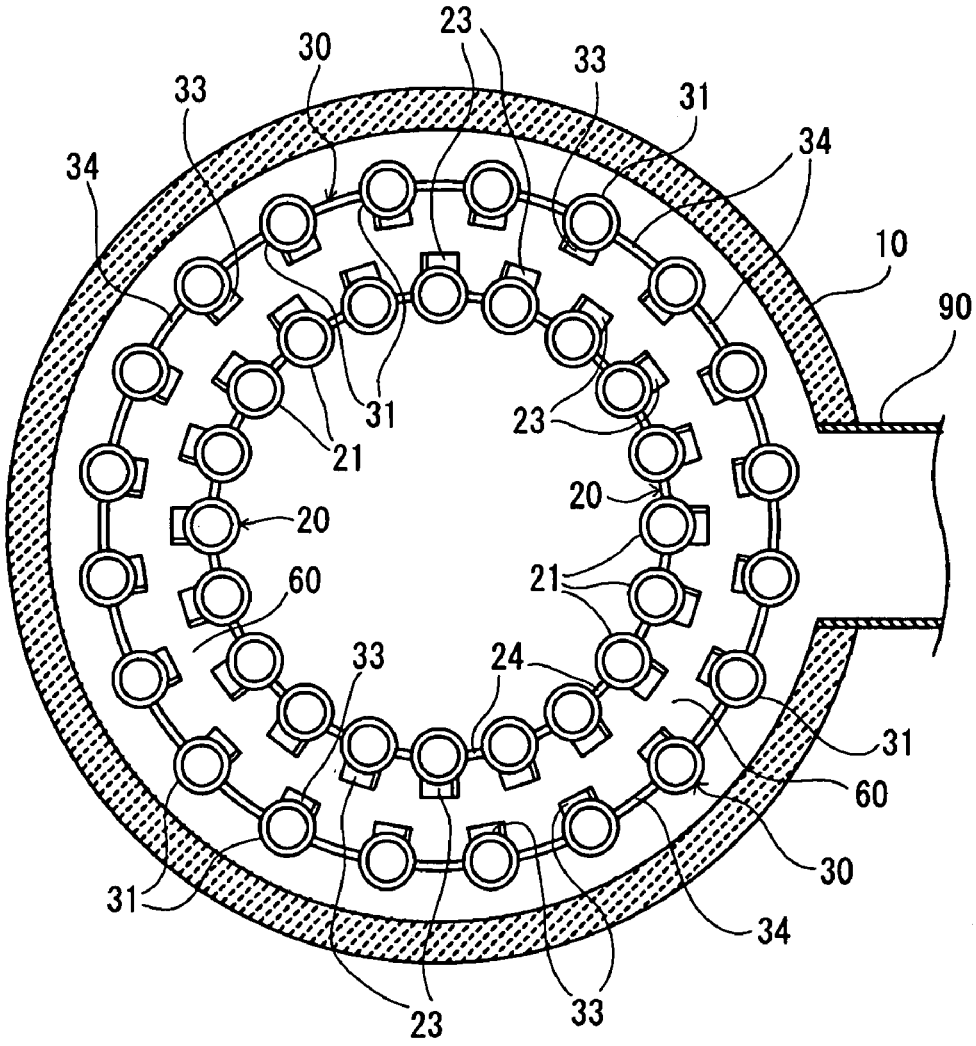
【FIG. 8】

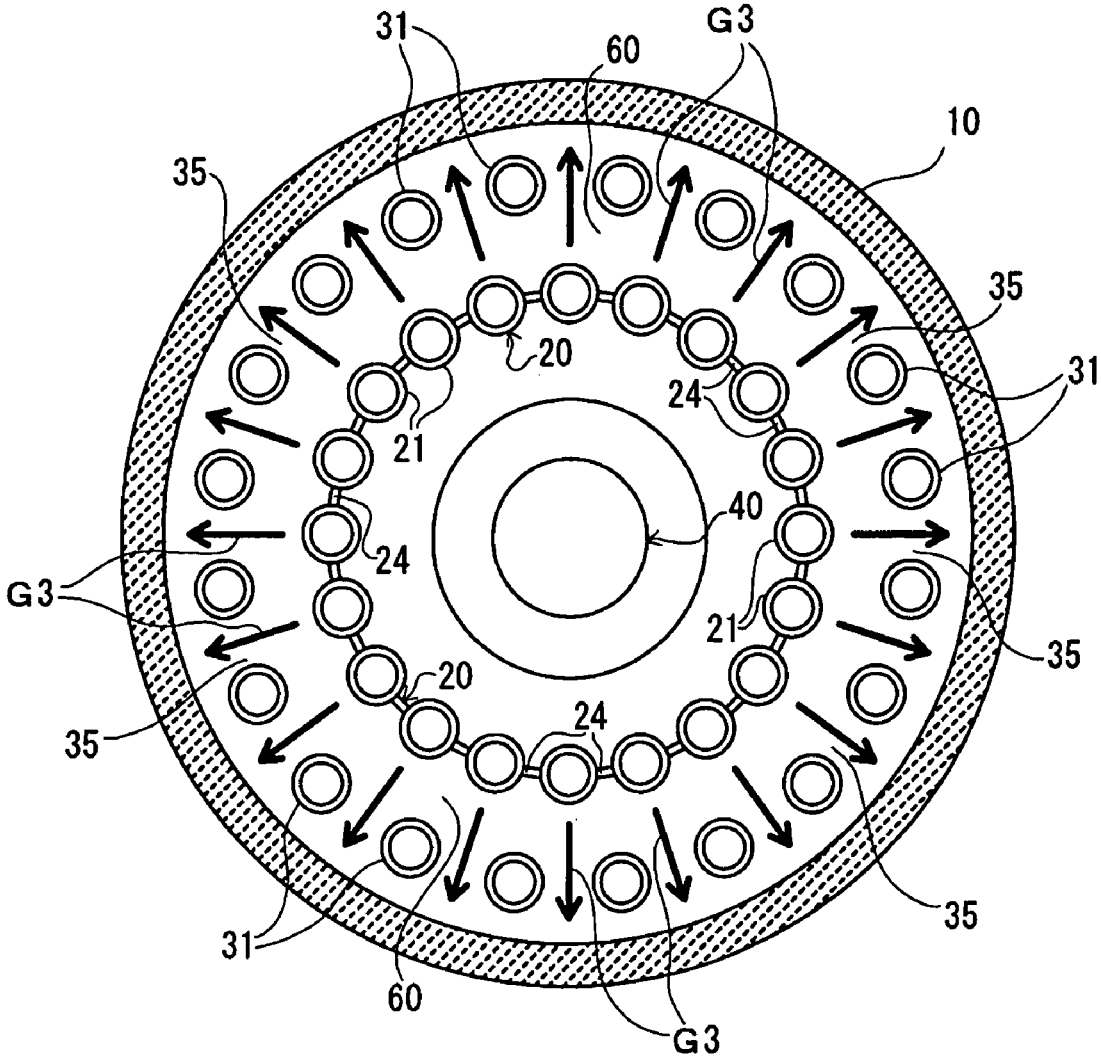
【FIG. 9】

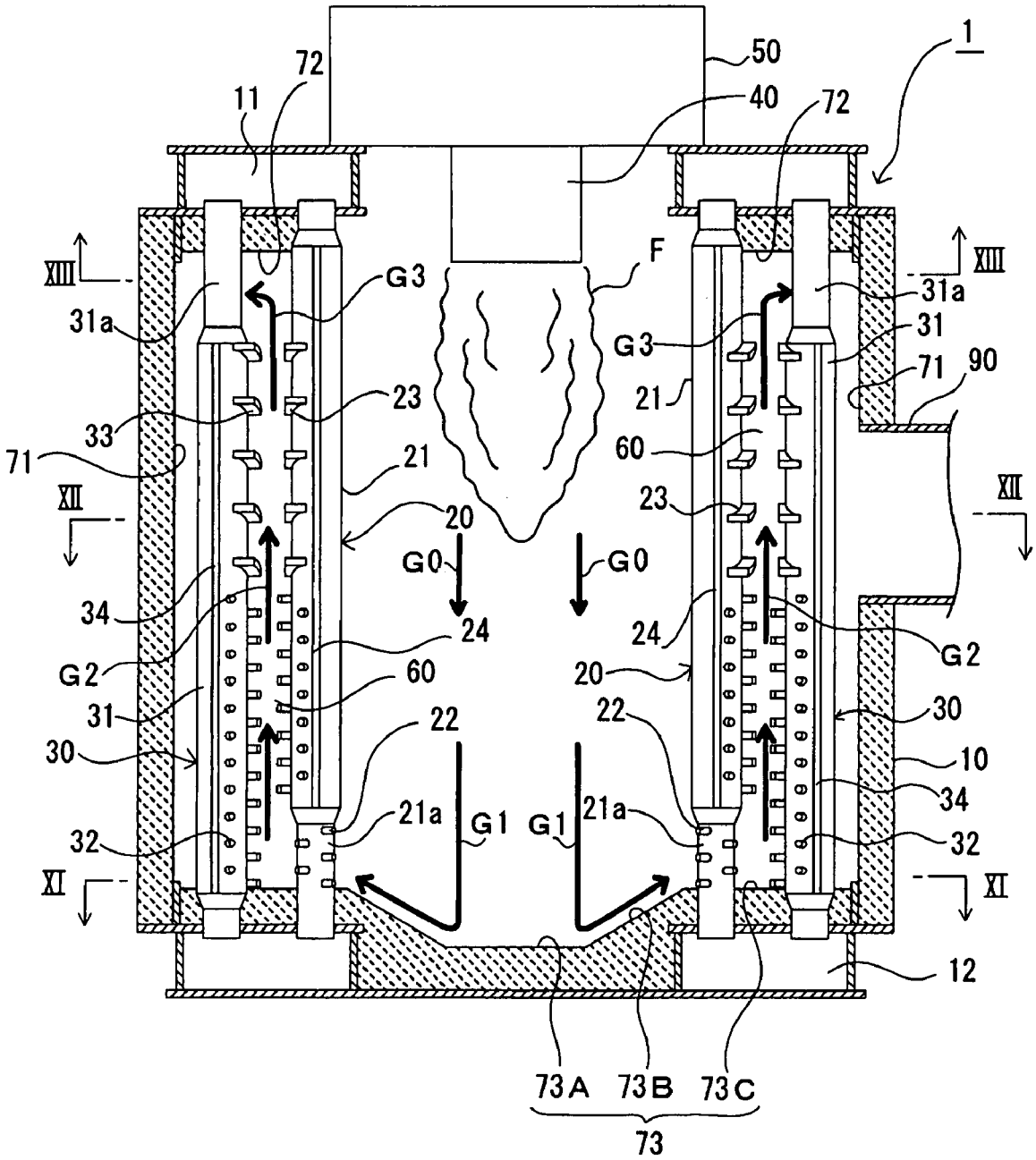
【FIG. 10】

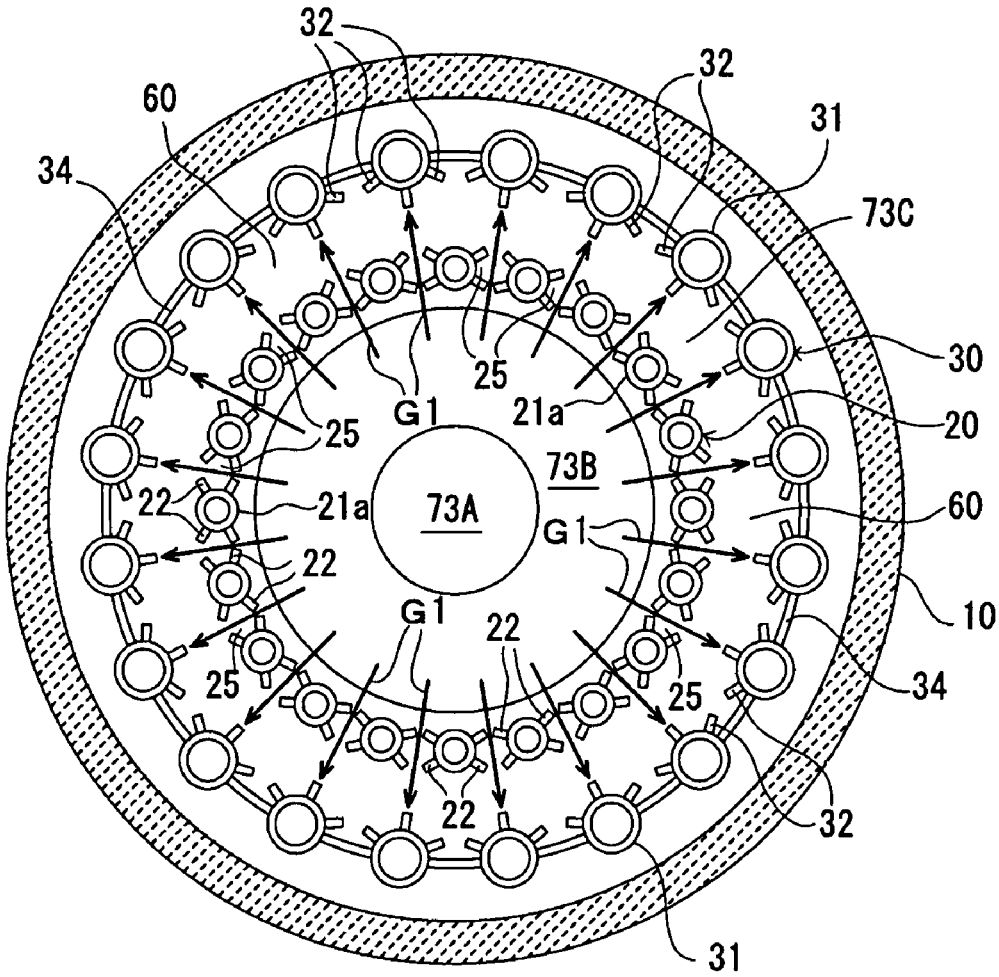
【FIG. 11】

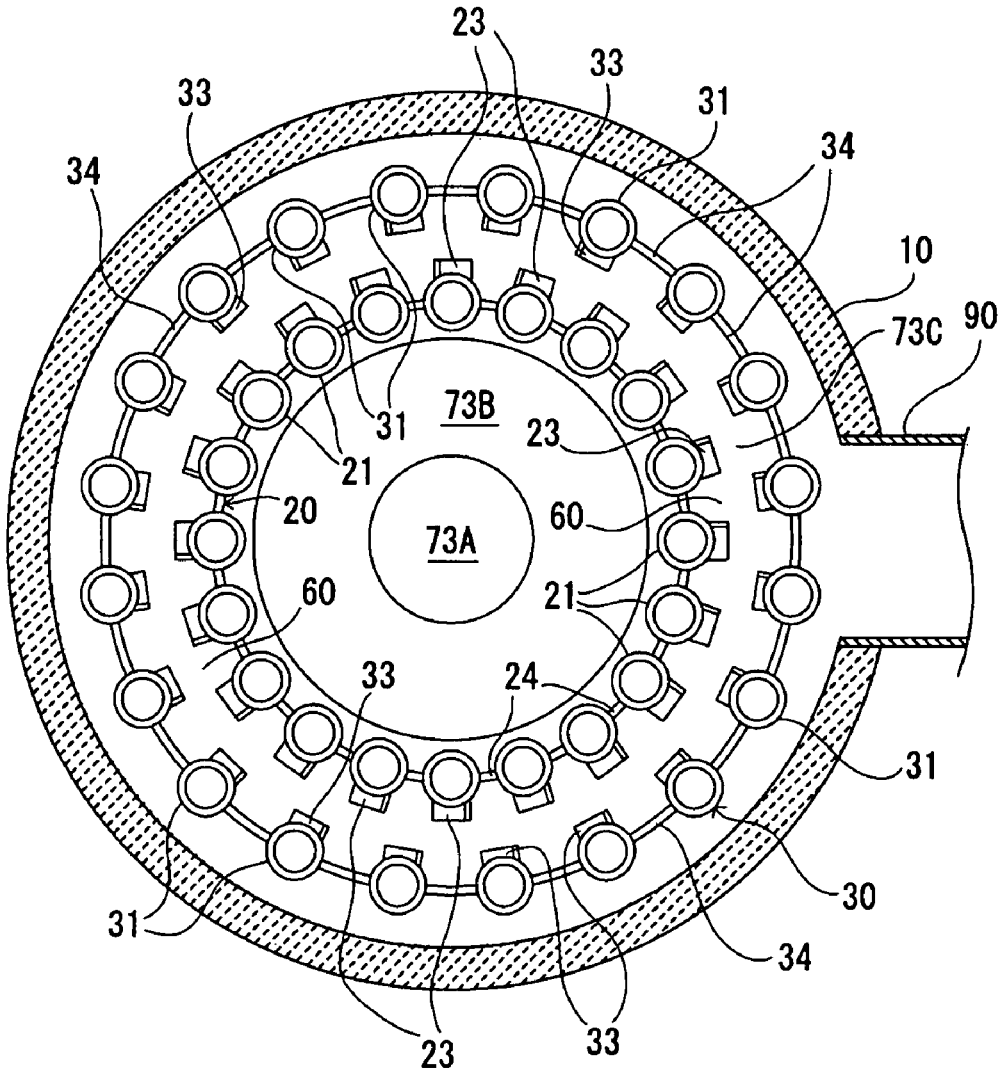
【FIG. 12】

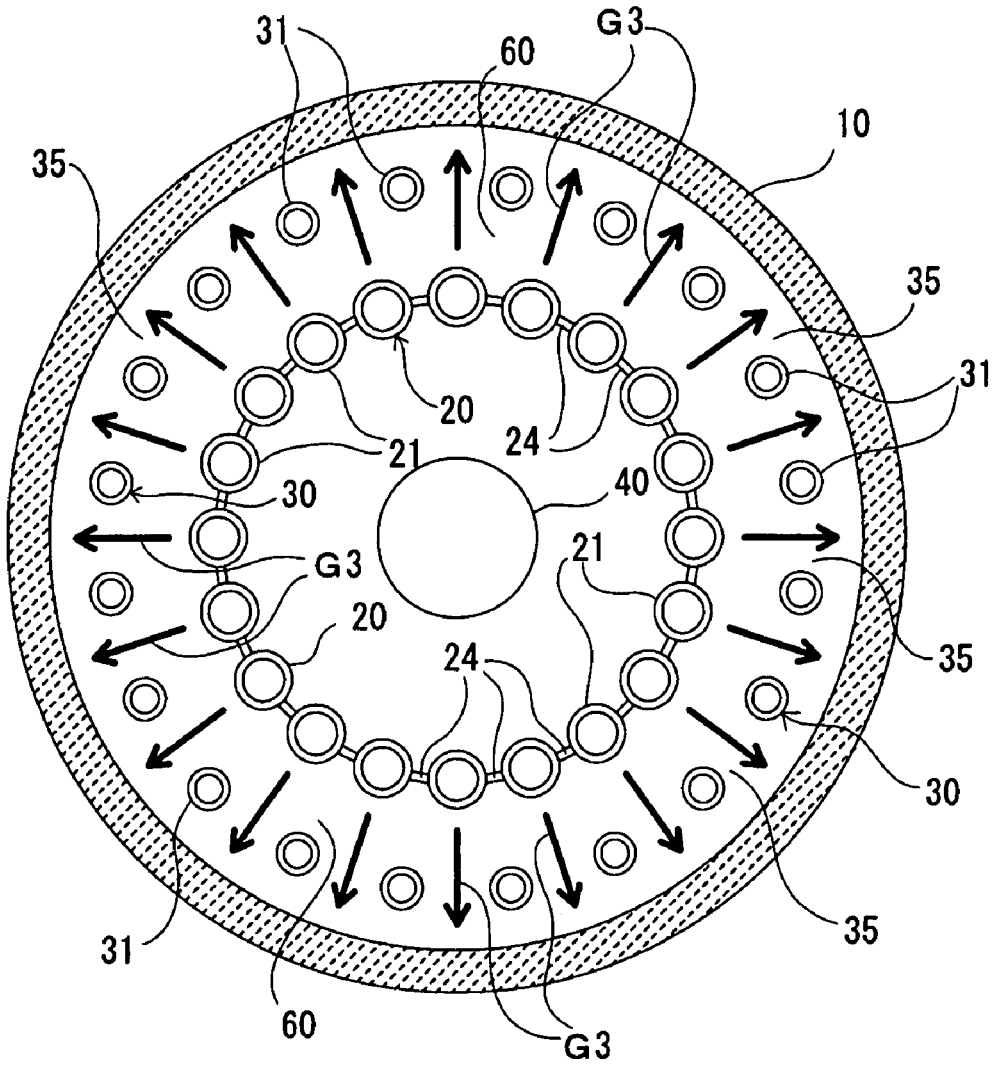
【FIG. 13】

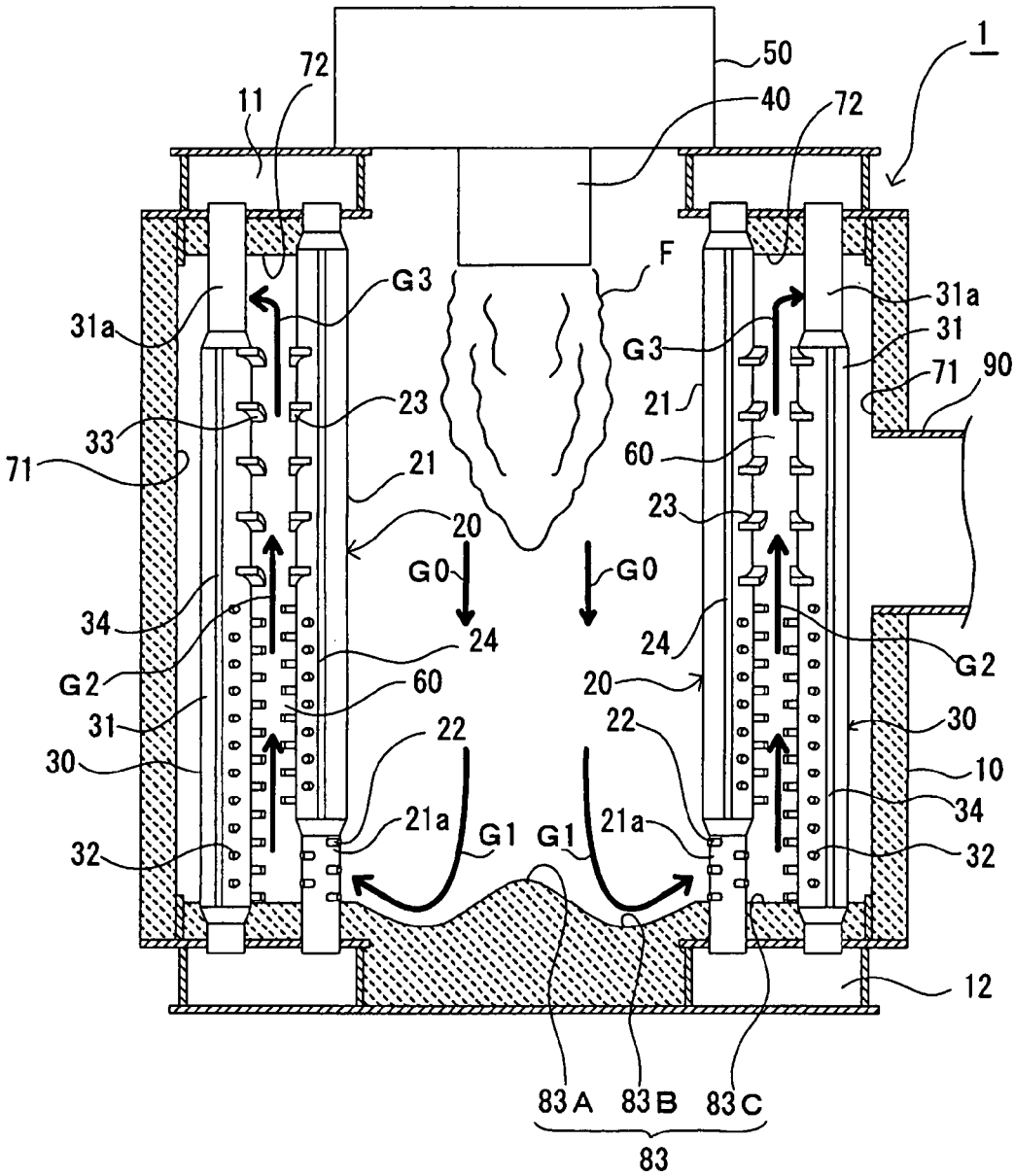
【FIG. 14】

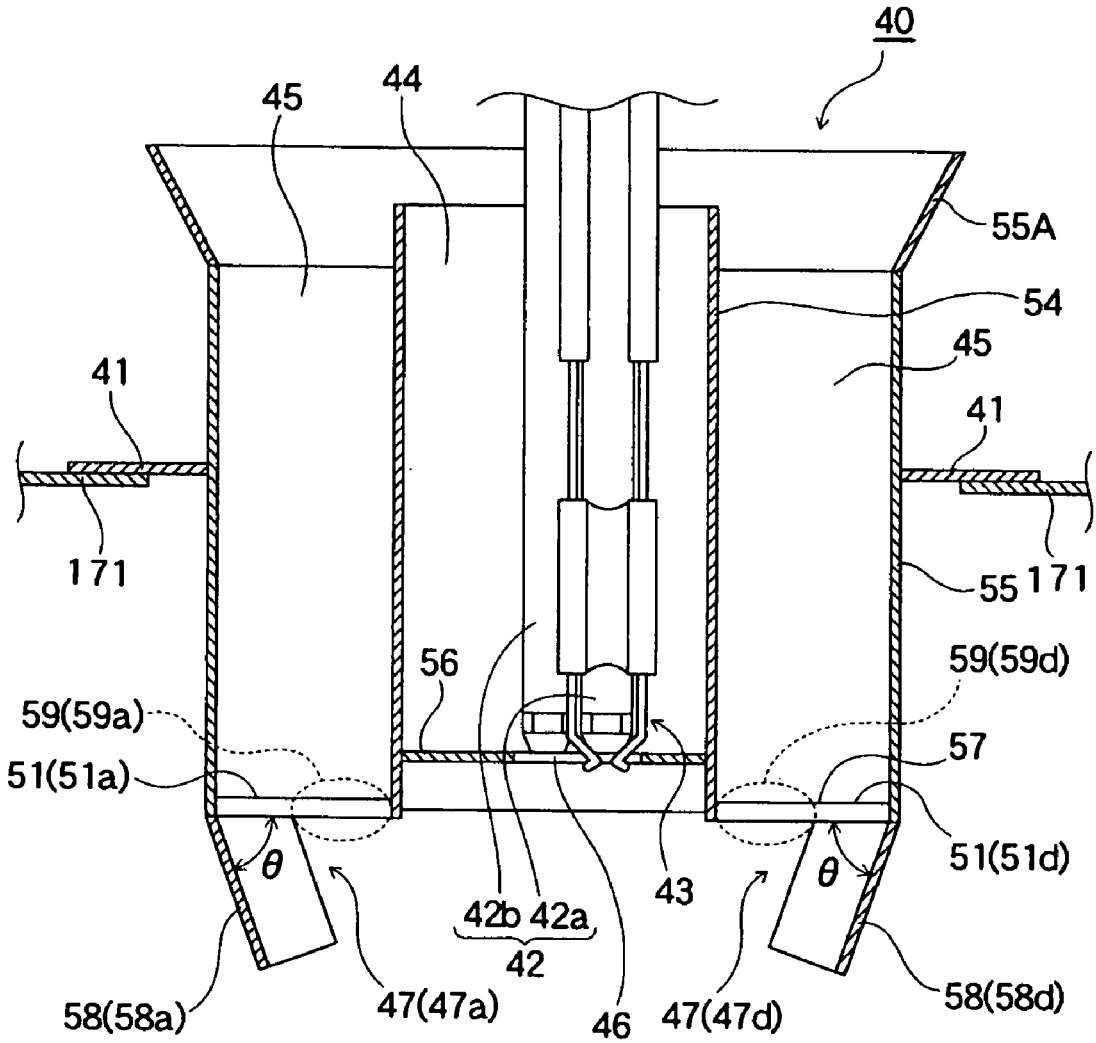
16
【FIG. 15】

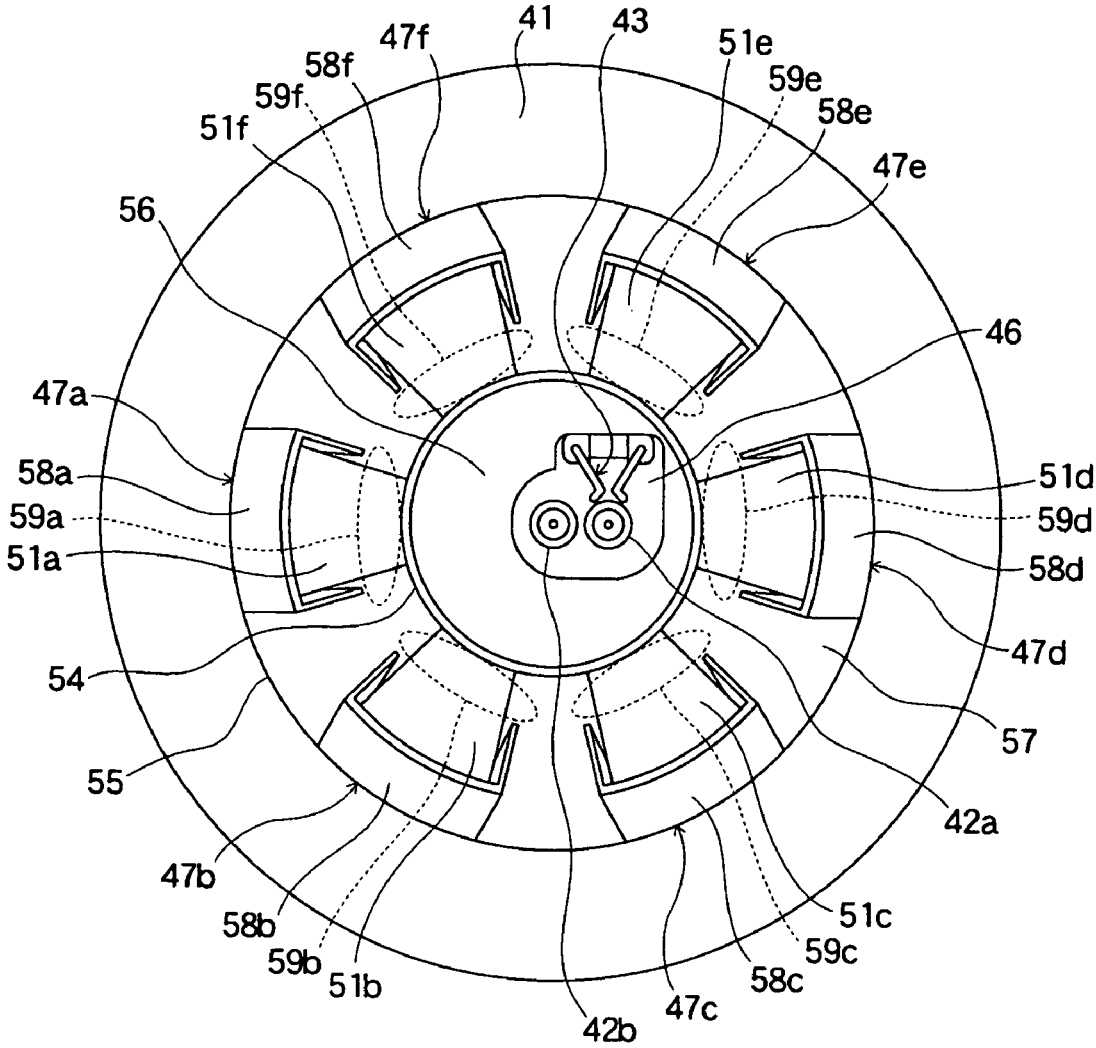
【FIG. 16】

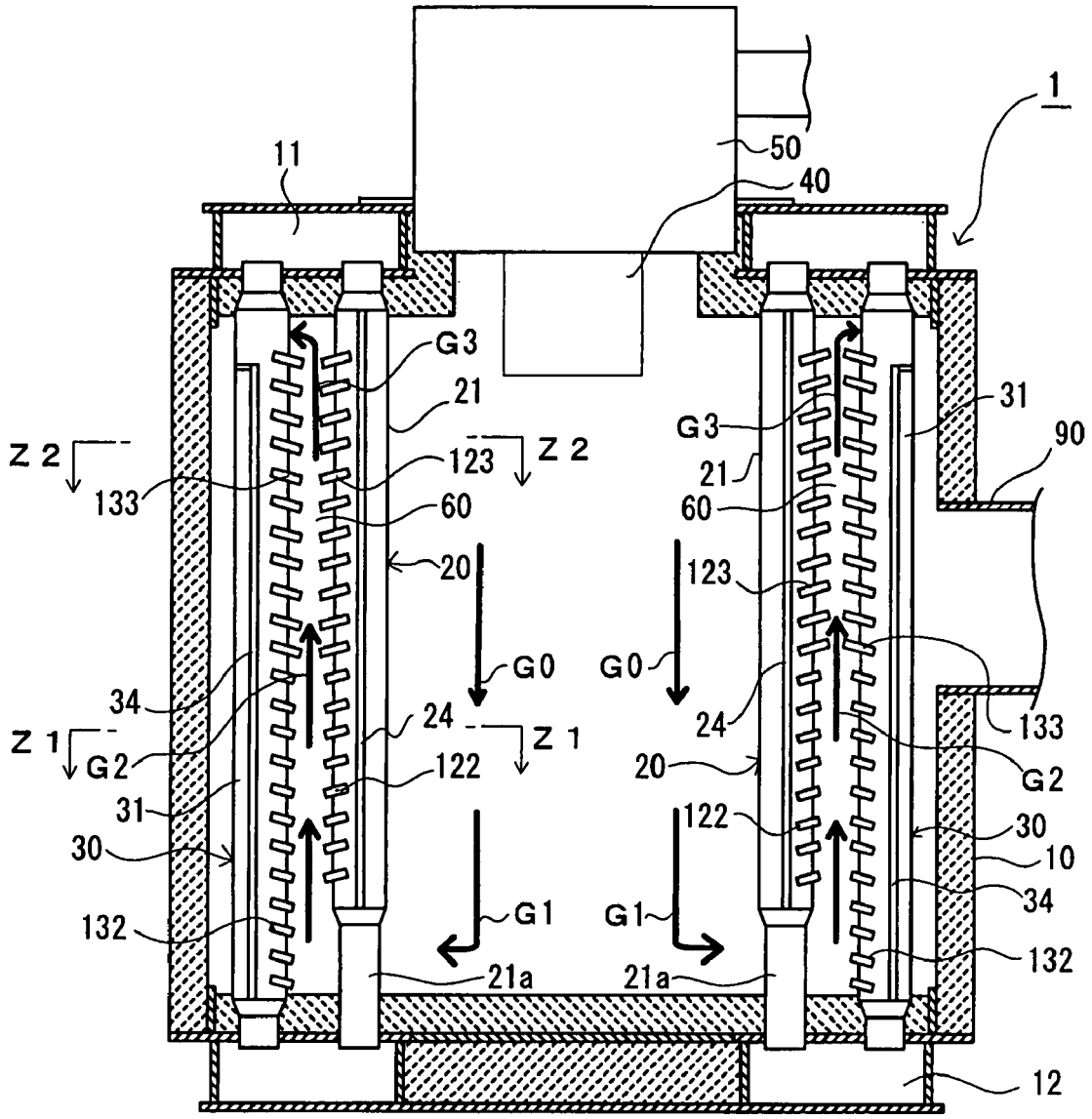
【FIG. 17】

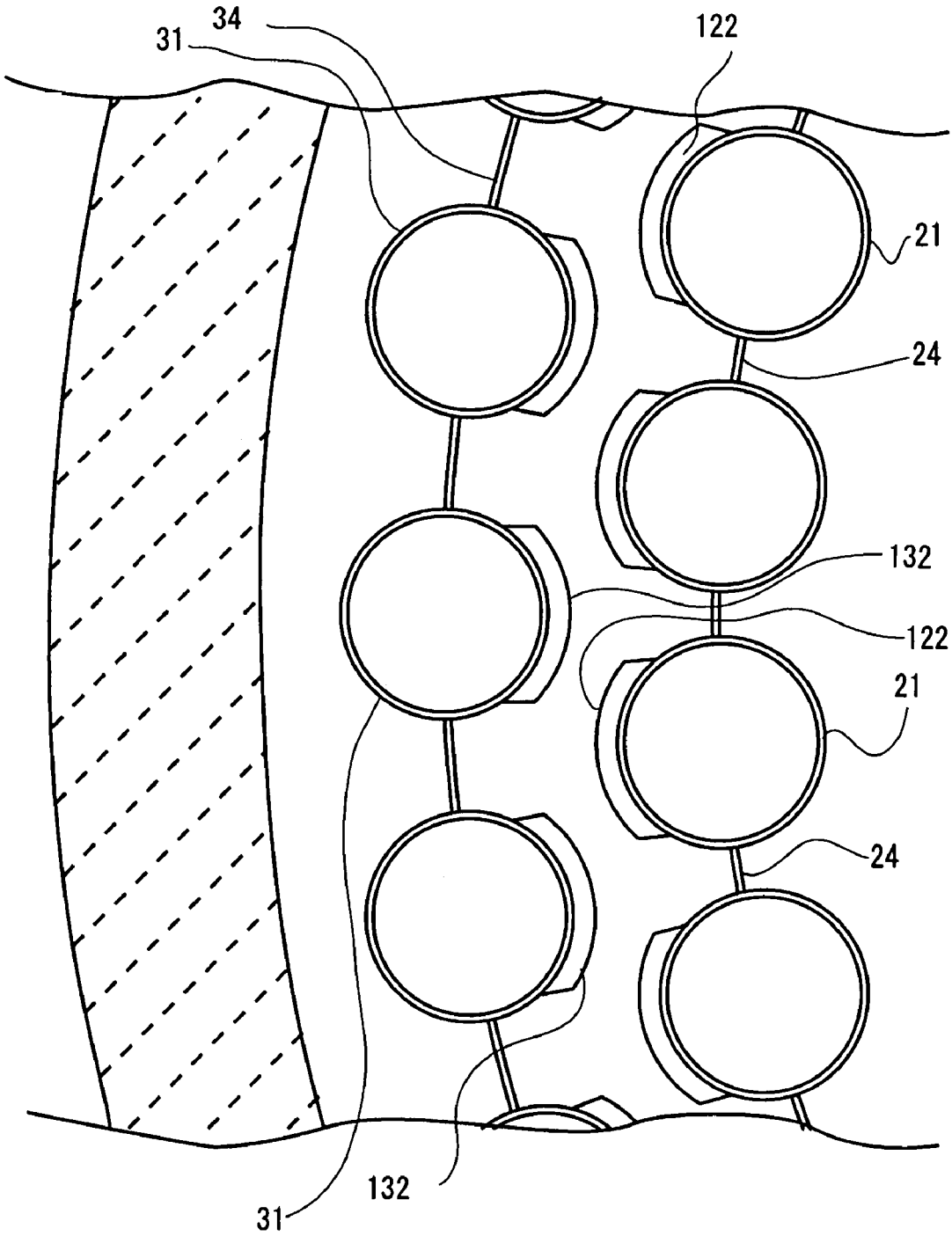
【FIG. 18】

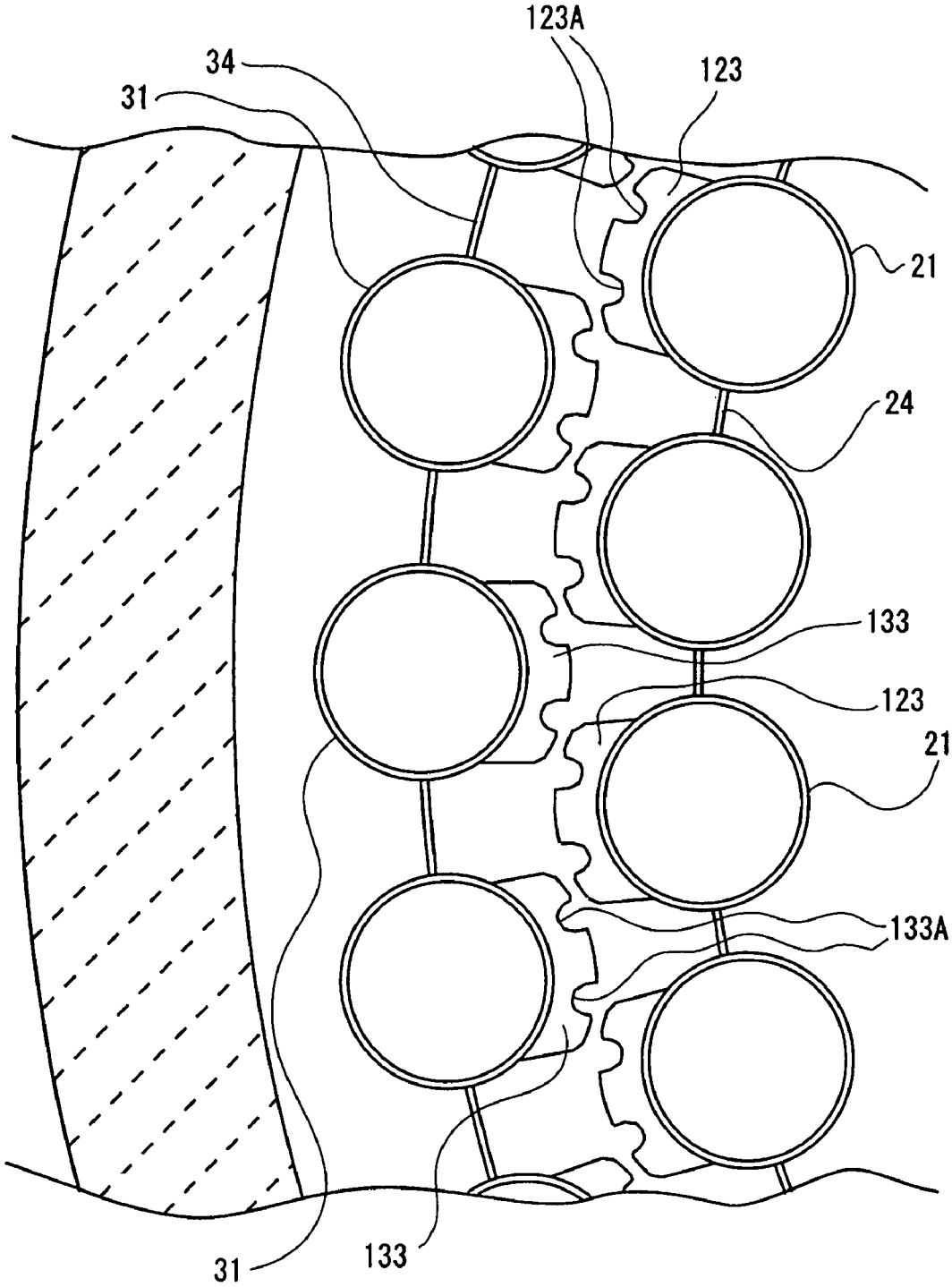
【FIG. 19】

BOILER

BACKGROUND OF THE INVENTION

1. Field of the Invention

The present invention relates to a boiler (multi-tube once-through boiler).

2. Description of the Related Art

A boiler has conventionally been well known which is equipped with a boiler body having a water tube group arranged in an annular fashion. In such a boiler, a burner is generally arranged at the center of the water tube group. That is, in a boiler of this construction, the portion at the center of the water tube group arranged in an annular fashion functions as a combustion chamber for burning the fuel supplied from the burner.

Further, regarding conventional boilers, in order to increase the amount of heat recovered from the combustion gas produced by the burner, a technique is known according to which predetermined water tubes constituting a water tube group are equipped with fins (see, for example, JP 02-75805 A).

However, the above conventional boiler has a problem in that effective heat recovery can not be conducted depending upon the positions of the fins installed on the water tubes. That is, the expansion heating surfaces provided on the water tube group constituting the boiler are not effectively utilized. Further, in some cases, the fins overheated by the combustion gas are cracked or detached.

SUMMARY OF THE INVENTION

The present invention has been made with a view toward solving the above problems in the prior art. It is an object of the present invention to provide a boiler equipped with a water tube group performing heat recovery effectively and having expansion heating surfaces (fins or the like) of high durability.

The present invention provides a boiler including: an inner water tube group and an outer water tube group that are arranged in an annular fashion; and a burner arranged at a central portion of the inner water tube group, in which: intervals between adjacent inner water tubes constituting the inner water tube group are closed except for portions where a gas flow passage is provided; and expansion heating surfaces (e.g., stud fins) are provided on a portion of at least one of the inner water tube group and the outer water tube group in a vicinity of the gas flow passage.

With this construction, the expansion heating surfaces (e.g., stud fins) are provided in the vicinity of the gas flow passages, where a large temperature difference is involved, so it is possible to perform heat recovery effectively. When stud fins are used as the expansion heating surfaces, cracking, detachment or the like does not easily occur even in an overheated state. Further, with this construction, expansion heating surfaces are provided in the vicinity of the gas flow passages, and heat recovery from the combustion gas is effected at an early stage, with the combustion gas temperature being lowered at an early stage. Thus, it is possible to achieve a reduction in generation of thermal NOx.

Further, in a boiler according to the present invention, it is desirable that the expansion heating surfaces (e.g., stud fins) be provided on the portions of the inner water tube group and the outer water tube group in the vicinity of the gas flow passage, and the outer water tube group be provided with more expansion heating surfaces (e.g., stud fins) than the inner water tube group.

According to the boiler of the present invention, the combustion gas produced by the burner provided at the center of the inner water tube group comes into contact with the outer water tube group via the gas flow passages, and then circulates between the water tube groups (i.e., between the inner water tube group and the outer water tube group). That is, the combustion gas is in contact with the outer water tube group for a longer period of time, so with this preferred construction (i.e., the construction in which the outer water tube group is equipped with more expansion heating surfaces than the inner water tube group), it is possible to perform heat recovery from the combustion gas more effectively.

Further, in a boiler according to the present invention, it is desirable that the expansion heating surfaces (e.g., stud fins) be provided solely on the portion of the outer water tube group in the vicinity of the gas flow passage.

As stated above, according to the boiler of the present invention, the combustion gas produced by the burner provided at the center of the inner water tube group impinges upon the outer water tube group via the gas flow passages, and then circulates between the water tube groups along the outer water tube group. Thus, with this preferred construction, it is possible to perform heat recovery from the combustion gas more effectively owing to the expansion heating surfaces (e.g., stud fins) provided on the outer water tube group, which is in contact with the combustion gas to a larger degree.

Further, in a boiler according to the present invention, it is desirable that the gas flow passage be provided in an annular fashion at one end of the inner water tube group. More specifically, in the boiler of the present invention, it is desirable for the gas flow passage to be provided in an annular fashion at the upper end or the lower end of the inner water tube group.

Further, in a boiler according to the present invention, it is desirable that plate-like fins inclined with respect to a gas flow be provided on the downstream side of the expansion heating surfaces (e.g., stud fins) be provided in the vicinity of the gas flow passage.

Further, in a boiler according to the present invention, it is desirable that the plate-like fins be inclined by 20 to 85 degrees with respect to the gas flow (from 5 to 70 degrees with respect to the horizontal direction).

According to the present invention, it is possible to obtain a boiler equipped with a water tube group performing heat recovery effectively and having expansion heating surfaces (fins or the like) of high durability. Further, according to the present invention, it is possible to obtain a boiler capable of achieving a reduction in NOx.

BRIEF DESCRIPTION OF THE DRAWINGS

In the accompanying drawings:

FIG. 1 is an explanatory longitudinal sectional view of a boiler according to a first embodiment of the present invention;

FIG. 2 is a schematic explanatory cross-sectional view taken along the line II-II of FIG. 1;

FIG. 3 is a schematic explanatory cross-sectional view taken along the line III-III of FIG. 1;

FIG. 4 is a schematic explanatory cross-sectional view taken along the line IV-IV of FIG. 1;

FIG. 5 is a schematic explanatory cross-sectional view of a boiler according to a second embodiment of the present invention;

FIG. 6 is an explanatory longitudinal sectional view of a boiler according to a third embodiment of the present invention;

FIG. 7 is a schematic explanatory cross-sectional view taken along the line VII-VII of FIG. 6;

FIG. 8 is a schematic explanatory cross-sectional view taken along the line VIII-VIII of FIG. 6;

FIG. 9 is a schematic explanatory cross-sectional view taken along the line IX-IX of FIG. 6;

FIG. 10 is an explanatory longitudinal sectional view of a boiler according to a fourth embodiment of the present invention;

FIG. 11 is a schematic explanatory cross-sectional view taken along the line XI-XI of FIG. 10;

FIG. 12 is a schematic explanatory cross-sectional view taken along the line XII-XII of FIG. 10;

FIG. 13 is a schematic explanatory cross-sectional view taken along the line XIII-XIII of FIG. 10;

FIG. 14 is an explanatory longitudinal sectional view of a boiler according to a fifth embodiment of the present invention;

FIG. 15 is an explanatory longitudinal sectional view of a burner according to an embodiment of the present invention;

FIG. 16 is a bottom view of the burner shown in FIG. 15;

FIG. 17 is an explanatory longitudinal sectional view of a boiler according to another embodiment of the present invention;

FIG. 18 is a schematic explanatory cross-sectional view taken along the line Z1-Z1 of FIG. 17; and FIG. 19 is a schematic explanatory cross-sectional view taken along the line Z2-Z2 of FIG. 17.

DETAILED DESCRIPTION OF THE PREFERRED EMBODIMENTS

Before a description of embodiments of the present invention, some of terms used in this specification will be described.

In this specification, a term "gas" implies at least one of the following two concepts: a gas under burning reaction and a gas that has completed burning reaction; it may also be referred to as "combustion gas". That is, unless otherwise specified, the term "gas" covers all of the following three cases: a case in which both the gas under burning reaction and the gas that has completed burning reaction coexist; a case in which only the gas under burning reaction exists; and a case in which only the gas that has completed burning reaction exists.

A term "exhaust gas" implies a gas that has completed or almost completed burning reaction. Further, unless otherwise specified, the term "exhaust gas" implies both or one of the following two concepts: a gas having passed through the boiler body of the boiler and reached a chimney portion, and a gas circulating within the boiler body.

In the following, embodiments of the present invention will be described.

First, a boiler according to a first embodiment mode is equipped with a boiler body having an inner water tube group and an outer water tube group arranged in an annular fashion and a burner arranged at the center of the inner water tube group, and is characterized in that the intervals between the adjacent inner water tubes forming the inner water tube group are closed except for a portion where gas flow passages are provided, and at least one of the portions of the inner water tube group and the outer water tube group in the vicinity of the gas flow passages is provided with expansion heating surfaces (e.g., stud fins).

In a boiler according to a second embodiment mode, in the construction of the first embodiment mode, the portions of the inner water tube group and the outer water tube group in the vicinity of the gas flow passages are provided with expansion heating surfaces (e.g., stud fins), with the outer water tube group being provided with more expansion heating surfaces (e.g., stud fins) than the inner water tube group.

In a boiler according to a third embodiment mode, in the construction of the first embodiment mode, solely the portion of the outer water tube group in the vicinity of the gas flow passages is provided with expansion heating surfaces (e.g., stud fins).

In a boiler according to a fourth embodiment mode, in any one of the constructions of the first through third embodiment modes, the gas flow passages are provided in an annular fashion at one end of the inner water tube group. That is, in the boiler of this embodiments, the flow passages are provided in an annular fashion at the upper end or the lower end of the inner water tube group.

Further, in a boiler according to a fifth embodiment mode, in any one of the constructions of the first through fourth embodiment modes, plate-like fins inclined with respect to the gas flow are provided on the downstream side of the expansion heating surfaces (e.g., stud fins) provided in the vicinity of the gas flow passages.

In a boiler according to a sixth embodiment mode, in the construction of the fifth embodiment mode, it is desirable for the inclination angle of the plate-like fins to range from 20 to 85 degrees with respect to the gas flow (from 5 to 70 degrees with respect to the horizontal direction).

First Embodiment

In the following, a boiler according to a second embodiment of the present invention will be described with reference to the drawings.

FIG. 1 is an explanatory longitudinal sectional view of a boiler according to the first embodiment of the present invention. FIG. 2 is a schematic explanatory cross-sectional view taken along the line II-II of FIG. 1. FIG. 3 is a schematic explanatory cross-sectional view taken along the line III-III of FIG. 1. FIG. 4 is a schematic explanatory cross-sectional view taken along the line IV-IV of FIG. 1.

As shown in FIG. 1, etc., a boiler 1 according to this embodiment is formed by using a boiler body 10 having water tube groups arranged in an annular fashion, and a burner 40 arranged at the center of the water tube groups; on top of the burner 40, there is provided a wind box 50 for supplying combustion air to the burner 40.

The boiler body 10 includes an upper header 11 and a lower header 12, between which a plurality of water tube groups (an inner water tube group 20 and an outer water tube group 30) are provided upright. The water tube groups 20 and 30 are arranged in substantially concentric circles, and the outer water tube group 30 is provided at a predetermined distance from the inner water tube group 20, with an annular gas flow passage 60 being formed between the inner water tube group 20 and the outer water tube group 30.

In this embodiment, the inner water tube group 20 is formed by using a plurality of inner water tubes 21 and first longitudinal fin portions 24. The inner water tubes 21 are arranged in an annular fashion at substantially equal predetermined intervals, and, between the inner water tubes 21, there are provided the first longitudinal fin portions 24 connected in order to eliminate the gaps formed between the adjacent inner water tubes 21. That is, in this embodiment, the inner water tube group 20 is formed in an annular fashion in a close contact state by using the first longitudinal fin portions 24.

Lower end portions 21*a* of the inner water tubes 21 are formed as reduced-diameter portions; in the inner water tube group 20 of this embodiment, the spaces around the reduced-diameter lower end portions 21*a* function as inner gas flow passages 25 (corresponding to the "gas flow passages" of the present invention) arranged in an annular fashion. That is, the inner gas flow passages 25 function to guide the gas produced in the inner water tube group 20 to the annular gas flow passage 60.

In this embodiment, the outer water tube group 30 is formed by using a plurality of outer water tubes 31 and second longitudinal fin portions 34. The outer water tubes 31 are arranged in an annular fashion at substantially equal predetermined intervals; between the outer water tubes 31, there are provided the second longitudinal fin portions 34 connected in order to eliminate the gaps formed between the adjacent outer water tubes 31. That is, in this embodiment, the outer water tube group 30 is formed in an annular fashion in a close contact state by using the second longitudinal fin portions 34.

Upper end portions 31*a* of the outer water tubes 31 are formed as reduced-diameter portions; in the outer water tube group 30 of this embodiment, the spaces around the reduced-diameter upper end portions 31*a* function as outer gas flow passages 35 arranged in an annular fashion. The outer gas flow passages 35 function to guide the gas introduced into the annular gas flow passage 60 toward an exhaust duct 90. That is, the gas produced in the inner water tube group 20 is gathered in the exhaust duct 90 via the inner gas flow passages 25, the annular gas flow passage 60, and the outer gas flow passages 35, and is discharged to the outside of the boiler body 10 through the exhaust duct 90.

Each of the inner water tubes 21 constituting the inner water tube group 20 is equipped with a plurality of first stud fins 22 (corresponding to the "expansion heating surfaces" of the present invention) at the lower end portions 21*a* thereof. On the portion of each inner water tube 21 situated on the downstream side (with respect to the gas flow) of the portion where the first stud fins 22 are provided, there are provided, on the annular gas flow passage 60 side thereof, a plurality of plate-like first fins 23 (corresponding to the "plate-like fins" of the present invention).

On the portion of each outer water tube 31 constituting the outer water tube group 30 in the vicinity of the inner gas flow passages 25, there are provided a plurality of second stud fins 32 (corresponding to the "expansion heating surfaces" of the present invention). On the portion of each outer water tube 31 situated on the downstream side (with respect to the gas flow) of the portion where the second stud fins 32 are provided, there are provided, on the annular gas flow passage 60, a plurality of plate-like second fins 33 (corresponding to the "plate-like fins" of the present invention).

That is, in this embodiment, the portions of the inner water tube group 20 (the inner water tubes 21 constituting the same) and the outer water tube group 30 (the outer water tubes 31 constituting the same) in the vicinity of the inner gas flow passages 25 are equipped with stud fins (the first stud fins 22 and the second stud fins 32), and plate-like fins (the first fins 23 and the second fins 33) are provided on the downstream side of those stud fins (the downstream side with respect to the gas flow). In this embodiment, the first fins 23 and the second fins 33 are provided so as to exhibit an inclination angle of 80 degrees with respect to the gas flow (the vertical flow) (an inclination angle of 10 degrees with respect to the horizontal direction). In this embodiment, it is desirable for the height of the plate-like first fins 23 and second fins 33 to range from approximately 6 to 12 mm. Further, in this embodiment, in addition to forming all the plate-like first fins 23 and second fins 33 in the same height, it is also possible to vary their heights as needed. For example, the height of the plate-like first fins 23 and second fins 33 situated in the lower portions may be 6 mm, and the height of the plate-like first fins 23 and second fins 33 situated in the higher portions may be 12 mm. That is, the extension length from the water tube outer peripheral surfaces of the lower fins (lateral fins) may be smaller than that of the upper fins (lateral fins).

The burner 40 constituting the boiler 1 of this embodiment is not limited to some particular construction; it is possible to adopt both a burner using a gas fuel and a burner using a liquid fuel. That is, in this embodiment, it is possible to use a burner of any construction as long as it is the burner 40 capable of properly forming a flame F within the boiler body 10 having the water tube groups 20 and 30 formed in an annular fashion.

The boiler 1 of this embodiment, constructed as described above, provides based on its construction the following effects, which will be described specifically with reference to the drawings (FIGS. 1 through 4).

As shown in FIG. 1, in this embodiment, the flame F (combustion gas) is formed so as to extend downwardly from the burner 40 provided at the center of the inner water tube group 20. A combustion gas G0 produced by the burner 40 flows downwards along the inner water tube group 20. The gas having flowed downwardly along the inner water tube group 20 impinges upon the lower surface of the boiler body 10, and then becomes a flow of a gas G1 radially flowing toward the periphery (see FIGS. 1 and 2) to be introduced into the annular gas flow passage 60 through the inner gas flow passages 25.

A G2 introduced into the annular gas flow passage 60 via the inner gas flow passages 25 flows upwardly along the inner water tube group 20 and the outer water tube group 30. In this process, the gas G2 flows upwardly while swirling according to the inclination angle of the plate-like fins (the first fins 23 and the second fins 33) provided to the inner water tube group 20 and the outer water tube group 30. And the gas G2 having flowed upwards while swirling impinges upon the upper surface of the boiler body 10, and is turned into a flow of a gas G3 (see FIGS. 1 and 4) flowing radially toward the periphery to be gathered in the exhaust duct 90 via the outer gas flow passages 35 before being discharged to the exterior of the boiler body 10 through the exhaust duct 90.

In the above-described gas flow, the heat energy of the flame (combustion gas) produced by the burner 40 is recovered by the inner water tube group 20 and the outer water tube group 30.

More specifically, first, on the inner surface side of the inner water tube group 20 (the burner 40 side (i.e., the combustion chamber side)), the gas G0, G1 comes into contact with the inner surfaces of the inner water tube group 20, whereby heat recovery is effected. Next, when the gas G1 passes through the inner gas flow passages 25, the gas G1 comes into contact with the inner water tube group 20 (the lower end portions 21*a* of the inner water tubes 21 constituting the same) and the first stud fins 22 provided in the vicinity of the inner gas flow passages 25, whereby heat recovery is effected.

Then, after the gas G1 has passed through the inner gas flow passages 25, the gas impinges upon the lower end portion of the outer water tube group 30; further, since the stud fins 22 and 32 are provided in the vicinity of the inner gas flow passages 25, turbulence is promoted in the vicinity of the inner gas flow passages 25. Thus, in the vicinity of the inner gas flow passages 25, the contact of the gas with the first stud fins 22 and the second stud fins 32 occurs effectively, whereby heat recovery is effected with high efficiency.

Next, the gas G2 flowing upwards through the annular gas flow passage 60 while swirling comes into contact with the inner water tube group 20, the outer water tube group 30, and the plate-like fins provided on the water tube groups 20 and 30 (the first fins 23 and the second fins 33), and, through this contact, heat recovery from the gas G2 is effected. Finally, the gas G3 having flowed upwardly through the annular gas flow passage 60 while swirling is held in contact with the outer side of the outer water tube group 30 (the exhaust duct 90 side) while it is gathered in the exhaust duct 90 via the outer gas flow passages 35, whereby heat recovery is effected.

According to this embodiment, the boiler 1 is constructed as described above, and the gas flows as described above within the boiler body 10 thereof, so it is possible to obtain a boiler equipped with water tube groups conducting heat recovery effectively and having expansion heating surfaces (fins or the like) of high durability.

More specifically, in the boiler 1 of this embodiment, the stud fins 22 and 32 (expansion heating surfaces) are provided in the vicinity of the inner gas flow passages 25 (the gas flow passages), which constitute a region involving a large temperature difference, so it is possible to conduct heat recovery effectively. Further, the expansion heating surfaces provided in the vicinity of the inner gas flow passages 25 are the stud fins 22 and 32, so, even if an overheated state is attained, cracking, detachment or the like does not easily occur. Further, with this construction, the stud fins 22 and 32 are provided in the vicinity of the inner gas flow passages 25 to effect heat recovery from the combustion gas at an early stage and to cause a reduction in the combustion gas temperature at an early stage, so it is possible to achieve a reduction in thermal NOx generation.

Further, in the boiler 1 of this embodiment, the plate-like fins 23 and 33 inclined with respect to the gas flow are provided on the downstream side of the stud fins 22 and 32 provided in the vicinity of the inner gas flow passages 25. With this construction, the heat energy not recovered by the stud fins 22 and 32 is not wasted but is recovered more effectively, thus making it possible to form the boiler 1 which can be operated with high efficiency.

Further, in the boiler 1 of this embodiment, the plate-like fins 23 and 33 provided on the downstream side of the stud fins 22 and 32 are inclined by a predetermined angle with respect to the gas flow, so the gas goes up through the annular inner gas flow passage 60 while swirling. That is, unlike the case in which the fins are provided at right angles with respect to the gas flow, the fins 23 and 33 of this embodiment do not hinder the gas flow, thus making is possible to provide the boiler 1 capable of realizing low pressure loss.

Further, as stated above, in the boiler 1 of this embodiment, it is possible to effect heat recovery effectively, which makes it possible to achieve a reduction in the boiler size. That is, by enhancing the heat recovery rate, it is possible to enhance the operational efficiency of the boiler, so the boiler size can be made much smaller.

Second Embodiment

Next, a boiler according to the second embodiment of the present invention will be described. The basic construction of the boiler of the second embodiment of the present invention is the same as that of the first embodiment described above. Thus, in the following, the portions that are the same as those of the first embodiment are indicated by the same reference numerals, and a detailed description thereof will be omitted, with the following description mainly centering on the difference in construction from the first embodiment.

FIG. 5 is a schematic explanatory cross-sectional view of the boiler of the second embodiment of the present invention. More specifically, it is a schematic explanatory view corresponding to FIG. 2 showing the first embodiment described above. That is, FIG. 5 is a schematic explanatory cross-sectional view of the portion of the boiler of this embodiment in the vicinity of the inner gas flow passages 25 (corresponding to the "gas flow passages" of the present invention).

As stated above, the boiler 1 of this embodiment is of the same basic construction as the first embodiment; it differs from the first embodiment in the number of stud fins 22 and 32 provided in the vicinity of the inner gas flow passages 25. As compared with the first embodiment, in this embodiment, the number of first stud fins 22 provided on the lower end portions 21*a* of the inner water tubes 21 is smaller, and the number of second stud fins 32 provided on the lower end portions of the outer water tubes 31 is larger. More specifically, no first stud fins 22 are provided on the annular gas flow passage 60 side of the lower end portions 21*a* of the inner water tubes 21, and the number of stud fins provided on the lower end portions of the outer water tubes 31 is increased by that number (i.e., by the number of stud fins reduced on the inner water tubes 21).

As described in relation to the first embodiment, after having passed through the inner gas flow passages 25, the gas G1 impinges upon the lower end portion of the outer water tube group 30. After this, in the vicinity of the inner gas flow passages 25, the gas flows upwards mainly along the outer water tube group 30. Then, it is to be assumed that, in the vicinity of the inner gas flow passages 25, the gas comes into contact more with the outer water tube group 30 than with the inner water tube group 20.

In this embodiment, attention is paid to this gas flow; the embodiment aims to provide the boiler 1 that can perform heat recovery with higher efficiency.

As stated above, in the boiler of this embodiment, the stud fins 22 and 32 are provided to the portions of the inner water tube group 20 and the outer water tube group 30 in the vicinity of the inner gas flow passages 25, with more stud fins being provided to the outer water tube group 30 than to the inner water tube group 20.

In the boiler 1 of this embodiment, the combustion gas produced by the burner 40 provided at the center of the inner water tube group 20 comes into contact with the outer water tube group 30 through the inner gas flow passages 25, and then circulates through the space between the water tube groups (the space between the inner water tube group 20, and the outer water tube group 30) (i.e. the annular gas flow passage 60). In this process, the gas flows continuously from the inner water tube group 20 toward the outer water tube group 30, so, in the annular gas flow passage 60, the gas can not help being in contact longer with the inner water tube group 30 than with the inner water tube 20. And, in this embodiment, more stud fins are provided to the outer water tube group 30 than to the inner water tube group 20, so heat recovery from the combustion gas can be conducted more effectively.

Further, in addition to the above effect, in the boiler 1 of this embodiment, the effect of the first embodiment can also be naturally obtained.

Third Embodiment

Next, a boiler according to the third embodiment of the present invention will be described. The basic construction of the boiler of the third embodiment of the present invention is the same as that of the first embodiment described above. Thus, in the following, the portions that are the same as those of the first embodiment are indicated by the same reference numerals, and a detailed description thereof will be omitted, with the following description mainly centering on the difference in construction from the first embodiment.

FIG. 6 is an explanatory longitudinal sectional view of a boiler according to the third embodiment of the present invention. FIG. 7 is a schematic explanatory cross-sectional view taken along the line VII-VII of FIG. 6. FIG. 8 is a schematic explanatory cross-sectional view taken along the line VIII-VIII of FIG. 6. FIG. 9 is a schematic explanatory cross-sectional view taken along the line IX-IX of FIG. 6.

As shown in FIG. 6, etc., a boiler 1 according to this embodiment is formed by using a boiler body 10 having water tube groups arranged in an annular fashion, and a burner 40 arranged at the center of the water tube groups; on top of the burner 40, there is provided a wind box 50 for supplying combustion air to the burner 40.

The boiler body 10 includes an upper header 11 and a lower header 12, between which a plurality of water tube groups (an inner water tube group 20 and an outer water tube group 30) are provided upright. The water tube groups 20 and 30 are arranged in substantially concentric circles, and the outer water tube group 30 is provided at a predetermined distance from the inner water tube group 20, with an annular gas flow passage 60 being formed between the inner water tube group 20 and the outer water tube group 30.

In this embodiment, the inner water tube group 20 is formed by using a plurality of inner water tubes 21 and first longitudinal fin portions 24. The inner water tubes 21 are arranged in an annular fashion at substantially equal predetermined intervals, and, between the inner water tubes 21, there are provided the first longitudinal fin portions 24 connected in order to eliminate the gaps formed between the adjacent inner water tubes 21. That is, in this embodiment, the inner water tube group 20 is formed in an annular fashion in a close contact state by using the first longitudinal fin portions 24.

Lower end portions 21*a* of the inner water tubes 21 are formed as reduced-diameter portions; in the inner water tube group 20 of this embodiment, the spaces around the reduced-diameter lower end portions 21*a* function as inner gas flow passages 25 (corresponding to the "gas flow passages" of the present invention) arranged in an annular fashion. That is, the inner gas flow passages 25 function to guide the gas produced in the inner water tube group 20 to the annular gas flow passage 60.

In this embodiment, the outer water tube group 30 is formed by using a plurality of outer water tubes 31 and second longitudinal fin portions 34. The outer water tubes 31 are arranged in an annular fashion at substantially equal predetermined intervals; between the outer water tubes 31, there are provided the second longitudinal fin portions 34 connected in order to eliminate the gaps formed between the adjacent outer water tubes 31. That is, in this embodiment, the outer water tube group 30 is formed in an annular fashion in a close contact state by using the second longitudinal fin portions 34.

As shown in FIG. 6, the second longitudinal fin portions 34 connected between the outer water tubes 31 are provided in order to secure a predetermined space between themselves and a heat insulating material provided on the upper portion of the inner wall of the boiler body 10; in the case of the outer water tube 30 of this embodiment, the space formed above the second longitudinal fin portions 34 (the space formed between the second longitudinal fin portions 34 and the upper heat insulating material) functions as an outer gas flow passage 35 formed in an annular configuration. The outer gas flow passage 35 functions to guide the gas introduced into the annular gas flow passage 60 toward the exhaust duct 90. That is, the gas produced inside the inner water tube group 20 is gathered in the exhaust duct 90 via the inner gas flow passages 25, the annular gas flow passage 60, and the outer gas flow passage 35, and is discharged to the exterior of the boiler body 10 through the exhaust duct 90.

Each of the inner water tubes 21 constituting the inner water tube group 20 is equipped with a plurality of first stud fins 22 (corresponding to the "expansion heating surfaces" of the present invention) at positions above the lower end portions 21*a* thereof. More specifically, the plurality of first stud fins 22 are provided on the surface portion of each inner water tube 21 from substantially the center to the lower portion thereof facing the annular gas flow passage 60. On the portion of each inner water tube 21 situated on the downstream side (with respect to the gas flow) of the portion where, the first stud fins 22 are provided, there are provided, on the annular gas flow passage 60 side thereof, a plurality of plate-like first fins 23 (corresponding to the "plate-like fins" of the present invention).

On the portion of each outer water tube 31 constituting the outer water tube group 30 in the vicinity of the inner gas flow passages 25, there are provided a plurality of second stud fins 32 (corresponding to the "expansion heating surfaces" of the present invention). More specifically, on the portion of each outer water tube 31 substantially from the central portion to the lower portion thereof, facing the annular gas flow passage 60, there are provided a plurality of second stud fins 32. On the portion of each outer water tube 31 situated on the downstream side (with respect to the gas flow) of the portion where the second stud fins 32 are provided, there are provided, facing the annular gas flow passage 60, a plurality of plate-like second fins 33 (corresponding to the "plate-like fins" of the present invention).

That is, in this embodiment, the portions of the inner water tube group 20 (the inner water tubes 21 constituting the same) and the outer water tube group 30 (the outer water tubes 31 constituting the same) in the vicinity of the inner gas flow passages 25 are equipped with stud fins (the first stud fins 22 and the second stud fins 32), and plate-like fins (the first fins 23 and the second fins 33) are provided on the downstream side of those stud fins (the downstream side with respect to the gas flow). In this embodiment, the first fins 23 and the second fins 33 are provided so as to exhibit an inclination angle of 80 degrees with respect to the gas flow (the vertical flow) (an inclination angle of 10 degrees with respect to the horizontal direction). In this embodiment, it is desirable for the height of the plate-like first fins 23 and second fins 33 to range from approximately 6 to 12 mm. Further, in this embodiment, in addition to forming all the plate-like first fins 23 and second fins 33 in the same height, it is also possible to vary their heights as needed. For example, the height of the plate-like first fins 23 and second fins 33 situated in the lower portions may be 6 mm, and the height of the plate-like first fins 23 and second fins 33 situated in the higher portions may be 12 mm. That is, the extension length from the water tube outer peripheral surfaces of the lower fins (lateral fins) may be smaller than that of the upper fins (lateral fins).

The burner 40 constituting the boiler 1 of this embodiment is not limited to some particular construction; it is possible to adopt both a burner using a gas fuel and a burner using a liquid fuel. That is, in this embodiment, it is possible to use a burner of any construction as long as it is the burner 40 capable of properly forming a flame F within the boiler body 10 having the water tube groups 20 and 30 formed in an annular fashion.

The boiler 1 of this embodiment, constructed as described above, provides, based on its construction, the same effects as those of the first embodiment described above.

Fourth Embodiment

Next, a boiler according to the fourth embodiment of the present invention will be described. The basic construction of the boiler of the fourth embodiment of the present invention is partially the same as that of the first embodiment described above. Thus, in the following, the portions that are the same as those of the first embodiment are indicated by the same reference numerals, and a detailed description thereof will be omitted, the following description mainly centering on the differences in construction from the first embodiment.

FIG. 10 is an explanatory longitudinal sectional view of the boiler according to the fourth embodiment of the present invention. FIG. 11 is a schematic explanatory cross-sectional view taken along the line XI-XI of FIG. 10. FIG. 12 is a schematic explanatory cross-sectional view taken along the line XII-XII of FIG. 10. FIG. 13 is a schematic explanatory cross-sectional view taken along the line XIII-XIII of FIG. 10.

As shown in FIG. 10, etc., a boiler 1 according to this embodiment is formed by using a boiler body 10 having water tube groups arranged in an annular fashion, and a burner 40 arranged at the center of the water tube groups; on top of the burner 40, there is provided a wind box 50 for supplying combustion air to the burner 40.

The boiler body 10 includes an upper header 11 and a lower header 12, between which a plurality of water tube groups (an inner water tube group 20 and an outer water tube group 30) are provided upright. The water tube groups 20 and 30 are arranged in substantially concentric circles, and the outer water tube group 30 is provided at a predetermined distance from the inner water tube group 20, with an annular gas flow passage 60 being formed between the inner water tube group 20 and the outer water tube group 30.

The inner surfaces (the side surface, the upper surface, and the lower surface) of the boiler body 10 are coated with a heat insulating material. More specifically, there are provided, by filling, a side heat insulating portion 71 on the side surface extending in the axial direction of the water tube groups 20 and 30, an upper heat insulating portion 72 at the upper end of the water tube groups 20 and 30 (the upper surface of the boiler body 10), and a lower heat insulating portion 73 (the lower heat insulating portion) at the lower end of the water tube groups 20 and 30 (the lower surface of the boiler body 10). The upper heat insulating portion 72 is provided on the upper surface of the boiler body 10 by filling such that the coated surface is a flat surface. The lower heat insulating portion 73 is provided on the lower surface of the boiler body 10 by filling such that the coated surface is a concave surface, which is constructed of a central recess portion 73A, an inclined portion 73B, and a flat portion 73C.

In this embodiment, the inner water tube group 20 is formed by using a plurality of inner water tubes 21 and first longitudinal fin portions 24. The inner water tubes 21 are arranged in an annular fashion at substantially equal predetermined intervals, and, between the inner water tubes 21, there are provided the first longitudinal fin portions 24 connected in order to eliminate the gaps formed between the adjacent inner water tubes 21. That is, in this embodiment, the inner water tube group 20 is formed in an annular fashion in a close contact state by using the first longitudinal fin portions 24.

Lower end portions 21*a* of the inner water tubes 21 are formed as reduced-diameter portions; in the inner water tube group 20 of this embodiment, the spaces around the reduced-diameter lower end portions 21*a* function as inner gas flow passages 25 (corresponding to the "gas flow passages" of the present invention) arranged in an annular fashion. That is, the inner gas flow passages 25 function to guide the gas produced in the inner water tube group 20 to the annular gas flow passage 60.

In this embodiment, the outer water tube group 30 is formed by using a plurality of outer water tubes 31 and second longitudinal fin portions 34. The outer water tubes 31 are arranged in an annular fashion at substantially equal predetermined intervals; between the outer water tubes 31, there are provided the second longitudinal fin portions 34 connected in order to eliminate the gaps formed between the adjacent outer water tubes 31. That is, in this embodiment, the outer water tube group 30 is formed in an annular fashion in a close contact state by using the second longitudinal fin portions 34.

Upper end portions 31*a* of the outer water tubes 31 are formed as reduced-diameter portions; in the outer water tube group 30 of this embodiment, the spaces around the reduced-diameter upper end portions 31*a* function as outer gas flow passages 35 arranged in an annular fashion. The outer gas flow passages 35 function to guide the gas introduced into the annular gas flow passage 60 toward an exhaust duct 90. That is, the gas produced in the inner water tube group 20 is gathered in the exhaust duct 90 via the inner gas flow passages 25, the annular gas flow passage 60, and the outer gas flow passages 35, and is discharged to the outside of the boiler body 10 through the exhaust duct 90.

Each of the inner water tubes 21 constituting the inner water tube group 20 is equipped with a plurality of first stud fins 22 (corresponding to the "expansion heating surfaces" of the present invention) at the lower end portions 21*a* thereof and positions above the lower end portions 21*a*. More specifically, the plurality of first stud fins 22 are provided on the surface portion of each inner water tube 21 from substantially the center to the lower portion thereof facing the annular gas flow passage 60. On the portion of each inner water tube 21 situated on the downstream side (with respect to the gas flow) of the portion where the first stud fins 22 are provided, there are provided, on the annular gas flow passage 60 side thereof, a plurality of plate-like first fins 23 (corresponding to the "plate-like fins" of the present invention).

On the portion of each outer water tube 31 constituting the outer water tube group 30 in the vicinity of the inner gas flow passages 25, there are provided a plurality of second stud fins 32 (corresponding to the "expansion heating surfaces" of the present invention). More specifically, on the portion of each outer water tube 31 substantially from the central portion to the lower portion thereof, facing the annular gas flow passage 60, there are provided the plurality of second stud fins 32. On the portion of each outer water tube 31 situated on the downstream side (with respect to the gas flow) of the portion where the second stud fins 32 are provided, there are provided, facing the annular gas flow passage 60, a plurality of plate-like second fins 33 (corresponding to the "plate-like fins" of the present invention).

That is, in this embodiment, the portions of the inner water tube group 20 (the inner water tubes 21 constituting the same) and the outer water tube group 30 (the outer water tubes 31 constituting the same) in the vicinity of the inner gas flow passages 25 are equipped with stud fins (the first stud fins 22 and the second stud fins 32), and plate-like fins (the first fins 23 and the second fins 33) are provided on the downstream side of those stud fins (the downstream side with respect to the gas flow). In this embodiment, the first fins 23 and the second fins 33 are provided so as to exhibit an inclination angle of 80 degrees with respect to the gas flow (the vertical flow) (an inclination angle of 10 degrees with respect to the horizontal direction). In this embodiment, it is desirable for the height of the plate-like first fins 23 and second fins 33 to range from approximately 6 to 12 mm. Further, in this embodiment, in addition to forming all the plate-like first fins 23 and second fins 33 in the same height, it is also possible to vary their heights as needed. For example, the height of the plate-like first fins 23 and second fins 33 situated in the lower portions may be 6 mm, and the height of the plate-like first fins 23 and second fins 33 situated in the higher portions may be 12 mm. That is, the extension length from the water tube outer peripheral surfaces of the lower fins (lateral fins) may be smaller than that of the upper fins (lateral fins).

The burner 40 constituting the boiler 1 of this embodiment is not limited to some particular construction; it is possible to adopt both a burner using a gas fuel and a burner using a liquid fuel. That is, in this embodiment, it is possible to use a burner of any construction as long as it is the burner 40 capable of properly forming a flame F within the boiler body 10 having the water tube groups 20 and 30 formed in an annular fashion.

The boiler 1 of this embodiment, constructed as described above, provides based on its construction the following effects, which will be described specifically with reference to the drawings (FIGS. 10 through 13).

As shown in FIG. 10, in this embodiment, the flame F (combustion gas) is formed so as to extend downwardly from the burner 40 provided at the center of the inner water tube group 20. A gas G0 produced by the burner 40 flows downwardly along the inner water tube group 20. The gas having flowed downwardly along the inner water tube group 20 impinges upon the lower surface of the boiler body 10 (the lower heat insulating portion 73), and is then turned into a gas G1 (see FIGS. 10 and 11) flowing radially toward the periphery before being introduced into the annular gas flow passage 60 through the inner gas flow passages 25. More specifically, the gas having flowed downwardly along the inner water tube group 20 first impinges upon the central recessed portion 73A constituting the lower heat insulating portion 73, and then flows obliquely upwards along the inclined portion 73B constituting the lower heat insulating portion 73 before being introduced into the annular gas flow passage 60 through the inner gas flow passages 25.

A G2 introduced into the annular gas flow passage 60 via the inner gas flow passages 25 flows upwardly along the inner water tube group 20 and the outer water tube group 30. In this process, the gas G2 flows upwardly according to the inclination angle of the plate-like fins (the first fins 23 and the second fins 33) provided to the inner water tube group 20 and the outer water tube group 30. And the gas G2 having flowed upwards impinges upon the upper surface of the boiler body 10, and is turned into a flow of a gas G3 (see FIGS. 10 and 13) flowing radially toward the periphery to be gathered in the exhaust duct 90 via the outer gas flow passages 35 before being discharged to the exterior of the boiler body 10 through the exhaust duct 90.

In the above-described gas flow, the heat energy of the flame (combustion gas) produced by the burner 40 is recovered by the inner water tube group 20 and the outer water tube group 30.

More specifically, first, on the inner surface side of the inner water tube group 20 (the burner 40 side (i.e., the combustion chamber side)), the gas G0, G1 comes into contact with the inner surfaces of the inner water tube group 20, whereby heat recovery is effected. Next, when the gas G1 passes through the inner gas flow passages 25, the gas G1 comes into contact with the inner water tube group 20 (the lower end portions 21*a* of the inner water tubes 21 constituting the same) and the first stud fins 22 provided in the vicinity of the inner gas flow passages 25, whereby heat recovery is effected.

Then, after the gas G1 has passed through the inner gas flow passages 25, the gas impinges upon the lower end portion of the outer water tube group 30; further, since the stud fins 22 and 32 are provided in the vicinity of the inner gas flow passages 25, turbulence is promoted in the vicinity of the inner gas flow passages 25. Thus, in the vicinity of the inner gas flow passages 25, the contact of the gas with the first stud fins 22 and the second stud fins 32 occurs effectively, whereby heat recovery is effected with high efficiency.

Next, the gas G2 flowing upwards through the annular gas flow passage 60 comes into contact with the inner water tube group 20, the outer water tube group 30, and the plate-like fins provided to the water tube groups 20 and 30 (the first fins 23 and the second fins 33), and, through this contact, heat recovery from the gas G2 is effected. Finally, the gas G3 having flowed upwardly through the annular gas flow passage 60 is held in contact with the outer side of the outer water tube group 30 (exhaust duct 90 side) while it is gathered in the exhaust duct 90 via the outer gas flow passages 35, whereby heat recovery is effected.

According to this embodiment, the boiler 1 is constructed as described above, and gas flows within the boiler body 10 thereof as described above, so the pressure loss of the boiler body is reduced, whereby it is possible to obtain a boiler in which the region allowing installation of the expansion heating surfaces such as fins is enlarged and in which expansion heating surfaces (fins or the like) of high durability are provided at positions allowing their installation to thereby prevent cracking, detachment, etc. of the expansion heating surfaces, making it possible to perform heat recovery effectively.

In the boiler 1 of this embodiment, the configuration of the lower heat insulating portion 73 provided at the lower end of the inner water tube group 20 is determined such that the combustion gas produced by the burner 40 can easily flow into the inner gas flow passages 25. More specifically, the gas having flowed downwardly along the inner water tube group 20 impinges upon the central recessed portion 73A constituting the lower heat insulating portion 73 on the lower surface of the boiler body 10, and then flows obliquely upwards along the inclined portion 73B constituting the lower heat insulating portion 73 to reach the flat portion 73C where the inner gas flow passages 25 are provided, the gas being introduced into the annular gas flow passage 60 through the inner gas flow passages 25. In this way, according to this embodiment, the heat insulating material (the lower heat insulating portion 73) provided to the lower portion of the boiler body (at the lower end of the inner water tube group) is formed in a configuration (recessed configuration) promoting the flow of the combustion gas, so the drift in the region where the combustion gas is turned (the lower portion of the boiler body) is diminished, thus making it possible to reduce the pressure loss of the boiler body.

As described above, in the boiler 1 of this embodiment, the drift in the lower portion of the boiler body is diminished (i.e., the pressure loss of the boiler body is reduced), so it is possible to provide a large number of expansion heating surfaces (stud fins 22, 32, etc.) in the vicinity of the inner gas flow passages 25, which is a region involving a large temperature difference. In this embodiment, the stud fins 22 and 32 are used as the expansion heating surfaces, so, even if an overheated state is attained, cracking, detachment, or the like does not easily occur to the expansion heating surfaces. Thus, according to this embodiment, the region allowing installation of the expansion heating surfaces such as fins is enlarged by reducing the pressure loss of boiler body, and expansion heating surfaces (fins, etc.) of high durability are provided in the region allowing the installation to thereby prevent cracking, detachment, or the like of the expansion heating surfaces, whereby it is possible to obtain a boiler capable of effectively performing heat recovery. Further, with this construction, the stud fins 22 and 32 are provided in the vicinity of the inner gas flow passages 25, and heat recovery from the combustion gas is effected at an early stage to cause an early reduction in combustion gas temperature, so it is possible to achieve a reduction in thermal NOx generation.

Further, in the boiler 1 of this embodiment, the plate-like fins 23 and 33 inclined with respect to the gas flow are provided on the downstream side of the stud fins 22 and 32 provided in the vicinity of the inner gas flow passages 25. With this construction, the heat energy not recovered by the stud fins 22 and 32 is not wasted but recovered more effectively, thus making is possible to form a boiler 1 capable of operation with high efficiency.

Further, in the boiler 1 of this embodiment, the plate-like fins 23 and 33 provided on the downstream side of the stud fins 22 and 32 are inclined by a predetermined angle with respect to the gas flow, with the gas going up within the annular gas flow passage 60. That is, in this embodiment, unlike in the case in which the fins are provided at right angles with respect to the gas flow, the fins 23 and 33 do not hinder the gas flow, so it is possible to provide a boiler 1 capable of realizing low pressure loss.

Further, as stated above, in the boiler 1 of this embodiment, it is possible to perform heat recovery effectively, so it is possible to achieve a reduction in boiler size. That is, by achieving an enhancement in heat recovery efficiency, it is possible to enhance the operational efficiency of the boiler, so the boiler can be made much smaller.

Fifth Embodiment

Next, a boiler according to the fifth embodiment of the present invention will be described. The basic construction of the boiler of the fifth embodiment of the present invention is the same as that of the fourth embodiment described above. Thus, in the following, the portions that are same as those of the fourth embodiment of the present invention are indicated by the same reference numerals, a detailed description thereof will be omitted, and the differences from the fourth embodiment of the present invention will be mainly described.

FIG. 14 is an explanatory longitudinal sectional view of a boiler according to the fifth embodiment of the present invention. More specifically, it is an explanatory view corresponding to FIG. 10 related to the fourth embodiment described above.

As described above, the boiler 1 of this embodiment is basically of the same construction as the fourth embodiment of the present invention, and differs from the fourth embodiment solely in the lower surface structure of the boiler body 10. More specifically, as shown in FIG. 14, in this embodiment, there are provided, by filling, the side heat insulating portion 71 extending in the axial direction of the water tube groups 20 and 30, the upper heat insulating portion 72 at the upper end of the water tube groups 20 and 30 (upper surface of the boiler body 10), and a lower heat insulating portion 83 (lower heat insulating portion). The upper heat insulating portion 72 is formed on the upper surface of the boiler body 10 by filling with insulating material such that the coated surface is flat. The lower heat insulating portion 83 is formed on the lower surface of the boiler body 10 by filling with insulating material so as to exhibit a convex coated surface, and includes a central protruding portion 83A, a recessed portion 83B, and a flat portion 83C.

The boiler 1 of this embodiment is constructed as described above and provides the following effects, which will be described specifically with reference to FIG. 14 (see FIGS. 11 through 13 if necessary).

As shown in FIG. 14, in this embodiment, the flame F (combustion gas) is formed so as to extend downwardly from the burner 40 provided at the center of the inner water tube group 20. The gas G0 produced by the burner 40 flows downwardly along the inner water tube group 20. The gas having flowed downwardly along the inner water tube group 20 impinges upon the lower surface of the boiler body 10 (lower heat insulating portion 83), and is then turned into the gas G1 flowing radially toward the periphery before being introduced into the annular gas flow passage 60 through the inner gas flow passages 25. More specifically, first, the gas having flowed downwardly along the inner water tube group 20 is evenly distributed toward the periphery in the central protruding portion 83A constituting the lower heat insulating portion 83, impinges upon the recessed portion 83B, and then flows obliquely upwards along the recessed portion 83B before being introduced into the annular gas flow passage 60 through the inner gas flow passages 25.

A gas G2 introduced into the annular gas flow passage 60 via the inner gas flow passages 25 flows upwardly along the inner water tube group 20 and the outer water tube group 30. In this process, the gas G2 flows upwardly according to the inclination angle of the plate-like fins (first fins 23 and second fins 33) provided on the inner water tube group 20 and the outer water tube group 30. Then, the gas G2 having flowed upwards impinges upon the upper surface of the boiler body 10, and is turned into a flow of a gas G3 flowing toward the periphery to be gathered in the exhaust duct 90 via the outer gas flow passages 35 before being discharged to the exterior of the boiler body 10 through the exhaust duct 90. In the gas flow, the heat energy of the flame (combustion gas) produced by the burner 40 is recovered by the inner water tube group 20 and the outer water tube group 30.

According to this embodiment, the boiler 1 is constructed as described above, and gas flows within the boiler body 10 thereof as described above, so the pressure loss of the boiler body is reduced, whereby it is possible to obtain a boiler in which the region allowing installation of the expansion heating surfaces such as fins is enlarged and expansion heating surfaces (fins or the like) of high durability are provided at positions allowing their installation to thereby prevent cracking, detachment, etc. of the expansion heating surfaces, making it possible to perform heat recovery effectively.

In the boiler 1 of this embodiment, the configuration of the lower heat insulating portion 83 provided at the lower end of the inner water tube group 20 is determined such that the combustion gas produced by the burner 40 can easily flow into the gas flow passages 25. More specifically, the gas having flowed downwardly along the inner water tube group 20 impinges upon the central protruding portion 83A constituting the lower heat insulating portion 83 on the lower surface of the boiler body 10, is evenly distributed toward the periphery, and then flows obliquely upwards along the recessed portion 83B constituting the lower heat insulating portion 83 to reach the flat portion 83C where the inner gas flow passages 25 are provided, the gas being introduced into the annular gas flow passage 60 through the inner gas flow passages 25. In this way, in this embodiment, the heat insulating material (lower heat insulating portion 83) provided in the lower portion of the boiler body (at the lower end of the inner water tube group) is formed in a configuration (protruding configuration) promoting the flow of the combustion gas, so the drift in the region where the combustion gas is turned (lower portion of the boiler body) is diminished, thus making it possible to reduce the pressure loss of the boiler body.

As described above, in the boiler 1 of this embodiment, as in the case of the fourth embodiment of the present invention, the drift in the lower portion of the boiler body is diminished (i.e., the pressure loss of the boiler body is reduced), so it is possible to provide a large number of expansion heating surfaces (stud fins 22, 32, etc.) in the vicinity of the gas flow passages 25, which is a region involving a large temperature difference. In this embodiment, the stud fins 22 and 32 are used as the expansion heating surfaces, so, even if an overheated state is developed, cracking, detachment, or the like does not easily occur to the expansion heating surfaces. Thus, according to this embodiment, the region allowing installation of the expansion heating surfaces such as fins is enlarged by reducing the pressure loss of the boiler body, and expansion heating surfaces (fins, etc.) of high durability are provided in the region allowing the installation to thereby prevent cracking, detachment, or the like of the expansion heating surfaces, whereby it is possible to obtain a boiler capable of effectively performing heat recovery. Further, with this construction, the stud fins 22 and 32 are provided in the vicinity of the inner gas flow passages 25, and heat recovery from the combustion gas is effected at an early stage to cause an early reduction in combustion gas temperature, so it is possible to achieve a reduction in thermal NOx generation.

Further, as described above, the boiler 1 of this embodiment is of the same construction as the fourth embodiment of the present invention except for the configuration of the lower heat insulating portion 83 provided at the lower end of the inner water tube group 20. Thus, also in the fifth embodiment of the present invention, it is possible to obtain all the effects explained in the fourth embodiment described above.

Other Embodiments, Etc.

The present invention is not limited to the above embodiment modes and embodiments (hereinafter referred to as "above embodiment modes, etc.") but can be carried out in various forms without departing from the scope of the gist of the present invention, all of such forms being covered by the technical scope of the present invention.

While in the above embodiment modes, etc., the stud fins 22 and 32 are provided on the portions of both the inner water tube group 20 and the outer water tube group 30 in the vicinity of the inner gas flow passages 25 (gas flow passages), the present invention is not limited to this construction. Thus, for example, it is also possible to adopt a construction in which stud fins are provided solely on the portion of the outer water tube group 30 in the vicinity of the inner gas flow passages 25. As described above, the gas flows continuously from the inner water tube group 20 toward the outer water tube group 30, so, within the annular gas flow passage 60, the gas is held in contact longer with the outer water tube group 30 than with the inner water tube group 20. Thus, also with this construction in which stud fins are provided solely on the portion of the outer water tube group 30 in the vicinity of the inner gas flow passages 25, it is possible to perform heat recovery from the combustion gas relatively effectively.

Further, while in the above embodiment modes, etc., the annular inner gas flow passages 25 (gas flow passages) are provided at the lower end of the inner water tube group, the present invention is not limited to this construction. Thus, for example, it is also possible to adopt a construction in which the annular inner gas flow passages (corresponding to the "gas flow passages" of the present invention) are provided at the upper end of the inner water tube group. In the case where the inner gas flow passages are provided at the upper end of the inner water tube group, it is desirable for the outer gas flow passages to be provided at the lower end of the outer water tube group in order to enhance the heat recovery rate (i.e., in order to increase the length of time that the gas is held in contact with the water tube groups).

Further, while in the above embodiment modes, etc., the boiler is formed by using a boiler body in which two rows of water tube groups are arranged substantially in the form of concentric circles, the present invention is not limited to this construction. It is also possible, as needed, to form a boiler body in which water tube groups are arranged in three or more rows. For example, in a case where the boiler body is formed by arranging the water tube groups in three concentric circles (e.g., an inner water tube group, an intermediate water tube group, and an outer water tube group), if the inner gas flow passages are provided at one end (e.g., lower end) of the inner water tube group, it is desirable to provide intermediate gas flow passages at the other end (e.g., upper end) of the intermediate water tube group and provide the outer gas flow passages at one end (e.g., lower end) of the outer water tube group.

Further, while in the above embodiment modes, etc., columnar stud fins 22 and 32 are used, the present invention is not limited to this construction; the stud fins may be of any other configuration as long as they are protrusions of high durability that can be properly welded to the water tubes. Thus, it is also possible, for example, to use stud fins of an oblique-column-shaped configuration, an elliptical-column-shaped configuration (inclusive of an oblique-elliptical-column-shaped configuration), a prism-shaped configuration (inclusive of an oblique-prism-shaped configuration), a cone-shaped configuration (inclusive of an oblique-cone-shaped configuration), or a pyramid-shaped configuration (inclusive of an oblique-pyramid-shaped configuration).

Further, while in the above embodiment modes, etc., no particular description is given of the structure of the burner 40, the present invention is not limited to some particular burner structure; it is also possible, for example, to adopt a burner 40 as shown in FIGS. 15 and 16. Here, FIG. 15 is an explanatory longitudinal sectional view of a burner according to an embodiment of the present invention, and FIG. 16 is a bottom view of the burner shown in FIG. 15.

The burner 40 constituting the boiler 1 of this embodiment is installed in a partition wall 171 in a wind box 50, which is an air supply device for supplying combustion air to the burner 40 (see FIG. 15). More specifically, a placing plate 41 constituting the burner 40 is placed from above on the partition wall 171 and is fastened to the partition wall 171 by fastening devices such as bolts (not shown), thereby installing the burner 40 in the partition wall 171 in the wind box 50.

As shown in FIGS. 15 and 16, for example, the burner 40 of this embodiment is formed by using a nozzle part 42 (first nozzle part 42*a* and second nozzle part 42*b*) (i.e., fuel spraying parts) for spraying a liquid fuel, an ignition device 43 provided such that the forward end thereof is situated in the vicinity of the first nozzle part 42*a*, air supply paths (first air supply path 44 for primary air supply and second air supply path 45 for secondary air supply) for mixing the air supplied from the wind box 50 with the liquid fuel sprayed from the nozzle part 42, a central air jetting part 46 for jetting the air supplied from the first air supply path 44 toward the combustion chamber 16, and a plurality of peripheral air jetting parts 47 (air jetting parts) (first peripheral air jetting part 47*a* through sixth peripheral air jetting part 47*f*).

As the nozzle part 42 of this embodiment, there are provided the first nozzle part 42*a* for spraying liquid fuel at the time of low combustion and at the time of high combustion, and the second nozzle part 42*b* for spraying liquid fuel solely at the time of high combustion. That is, the nozzle part 42 includes the first nozzle part 42*a* which is in the fuel supply state at the time of low combustion (and at the time of high combustion), and the second nozzle part 42*b* which is in the fuel supply state at the time of high combustion, switching being effected as appropriate between the nozzle part 42 according to the combustion load of the boiler. That is, the nozzle part 42*a* and 42*b* are on/off-controlled as needed.

The first air supply path 44 constituting the burner 40 is formed by using a first cylinder member 54 provided on the outer side of the nozzle part 42, and the second air supply path 45 is formed by using the first cylinder member 54. That is, the region on the inner side of the first cylinder member 54 functions as the first air supply path 44, and the region defined between the first cylinder member 54 and a second cylinder member 55 functions as the second air supply path 45. In the upper end portion of the second cylinder member 55, there is formed a divergent portion 55A diverging outwardly as it extends upwards. The reason for providing the divergent portion 55A of this configuration is to allow the air supplied from the wind box 50 to flow uniformly with respect to the cross-sectional direction within the second air supply path 45. If the divergent portion 55A were not provided, the air flow would be allowed to adhere to the inner wall of the second cylinder member 55, thus failing to flow uniformly with respect to the cross-sectional direction within the second air supply path 45.

At the forward end (side end of the combustion chamber 16 of the boiler 1) of the first cylinder member 54, there is provided a first air supply plate 56 having the central air jetting part 46, and the air supplied from the wind box 50 is jetted toward the combustion chamber 16 through the central air jetting part 46. At the forward end (side end of the combustion chamber 16 of the boiler 1) of the second cylinder member 55, there is provided a second air supply plate 57 having the plurality of peripheral air jetting parts 47 and the air supplied from the wind box 50 is jetted toward the combustion chamber 16 not only through the central air jetting part 46 but also through the plurality of peripheral air jetting parts 47.

As shown in FIGS. 15 and 16, the peripheral air jetting parts 47 (air jetting parts) are provided around the nozzle part 42. The peripheral air jetting parts 47 are constructed so as to jet air inwardly so that the gas produced by the burner 40 may not outwardly expand. With this construction, the liquid fuel and the flame (gas) at the stage of combustion start do not easily come into contact with the inner water tube group 20, so an inappropriate incomplete combustion in close proximity to the burner 40 is eliminated, thus making it possible to effectively prevent generation of CO and soot dust.

The peripheral air jetting parts 47 of this embodiment have guide portions 58 (first guide portion 58*a* through sixth guide portion 58*f*) for guiding the air jetted from the peripheral air jetting parts 47 (first peripheral air jetting part 47*a* through sixth peripheral air jetting part 47*f*) inwardly (i.e., toward the nozzle part 42) and diffusing portions 59 (first diffusing portion 59*a* through sixth diffusing portion 59*f*) promoting diffusion of the air jetted from the peripheral air jetting parts 47 (first peripheral air jetting part 47*a* through sixth peripheral air jetting part 47*f*).

More specifically, in this embodiment, the second air supply plate 57 has six substantially trapezoidal through-hole portions 51 (first through-hole portion 51*a* through sixth through-hole portion 51*f*), and the guide portions 58 (first guide portion 58*a* through sixth guide portion 58*f*) are formed on the outer peripheral sides of the through-hole portions 51 (on the sides farther away from the nozzle part 42) by using plate-like members. The guide portions 58 are formed so as to partially cover the through-hole portions 51; in this embodiment, the portions not covered with the guide portions 58 function as the diffusing portions 59 (first diffusing portion 59*a* through sixth diffusing portion 59*f*) promoting diffusion of the air jetted from the peripheral air jetting parts 47.

The guide portions 58 are formed with the plate-like members inclined so as to jet at least a part of the air jetted from the peripheral air jetting parts 47 (mainly the air of the regions of the through-hole portions 51 covered with the guide portions 58) inwardly (i.e., toward the nozzle part 42). It is desirable for the inclination angle θ (mounting angle) to be approximately 20 to 60 degrees.

Further, the height of the guide portions 58 is set so as to avoid contact with the liquid fuel sprayed from the nozzle part 42 in a cone-shaped configuration (in a triangular-pyramid shape with the nozzle part 42 being the apex thereof).

As stated above, the diffusing portions 59 (first diffusing portion 59*a* through sixth diffusing portion 59*f*) are the portions of the through-hole portions 51 not covered with the guide portions 58 (regions encircled by the dashed lines in FIGS. 15 and 16). Those portions (diffusing portions 59) are not provided with elements such as the guide portions 58 for rectifying the flow of air supplied through the second air supply path 45, so the air jetted from the diffusing portions 59 expands abruptly.

Thus, in the burner 40 of this embodiment, the air jetted from the peripheral air jetting parts 47 is guided inwardly by the guide portions 58, and diffusion of a part of the guided air is promoted by the diffusing portions 59.

In the burner 40 of this embodiment, by switching the fuel supply state in the nozzle part 42 appropriately (under on/off control), it is possible to effect switching for any one of the states between stop, low combustion, and high combustion. That is, when the combustion state is continued, switching is possible from low combustion to high combustion or from high combustion to low combustion.

The amount of air supplied to the burner 40 is generally adjusted by using a damper (not shown) provided in a duct between the wind box 50 and the blower, an inverter (not shown) for controlling the RPM of the blower, etc. This air is supplied in correspondence with the supply amount of the liquid fuel. For example, in a burner formed by using two nozzle tips of the same fuel supply performance, assuming that the amount of air supplied when liquid fuel is sprayed from one of the nozzle tips (at the time of low combustion) is "1", the amount of air supplied when the liquid fuel is sprayed from both nozzle tips (at the time of high combustion) is "2". Such adjustment of the air amount is conducted by using the damper, the inverter, etc.

As shown in FIG. 15, etc., in the burner 40 constructed and functioning as described above, the guide portions 58 are provided in order to inwardly jet the air from the peripheral air jetting parts 47. Thus, in the burner 40, the flame F (i.e., combustion gas) (not shown) is formed so as to extend downwardly with its expansion suppressed. Further, the combustion gas G0 produced by the burner 40 flows downwardly along the inner water tube group 20. The gas having downwardly flowed along the inner water tube group 20 impinges upon the lower surface of the boiler body 10, is turned into a flow of the gas flow G1, and then flows radially toward the periphery before being introduced into the annular gas flow passage 60 through the inner gas flow passages 25.

A combustion gas G2 introduced into the annular gas flow passage 60 via the inner gas flow passages 25 flows upwardly along the inner water tube group 20 and the outer water tube group 30. In this process, the gas G2 flows upwardly according to the inclination angle of the plate-like fins (first fins 23 and second fins 33) provided on the inner water tube group 20 and the outer water tube group 30. Then, the gas G2 having flowed upwards impinges upon the upper surface of the boiler body 10, and is turned into a flow of a gas G3 flowing toward the periphery to be gathered in the exhaust duct 90 via the outer gas flow passages 35 before being discharged to the exterior of the boiler body 10 through the exhaust duct 90.

In the above-described gas flow, the heat energy of the flame (combustion gas) produced by the burner 40 is recovered by the inner water tube group 20 and the outer water tube group 30.

By using the burner 40 of this embodiment, the peripheral air jetting parts 47 have the guide portions 58, so it is possible to control the flow of the flame (i.e., gas) according to the construction of the boiler body (positions of the gas flow passages, etc.), making it possible to achieve a reduction in harmful-substances (i.e., reduction in soot dust and reduction in NOx). In this embodiment, the inner gas flow passages 25 of the boiler body 10 are formed annularly in the lower portion thereof, causing the gas to flow uniformly with respect to the inner gas flow passages 25 and further, in order to prevent the gas, etc. from coming into contact with the inner water tube group 20 at an early stage, the guide portions 58 are provided with an angle allowing the combustion air to be jetted inwardly (toward the nozzle part 42). With this construction, when the combustion air is jetted inwardly, the liquid fuel and the flame (i.e., gas) at the combustion start stage do not easily come into contact with the inner water tube group 20 of the boiler body 10, so it is possible to eliminate an inappropriate incomplete combustion in the vicinity of the burner 40, thus making it possible to effectively prevent generation of CO and soot dust.

Further, with this construction, due to the provision of a plurality of peripheral air jetting parts 47 around the nozzle part 42, a divisional flame can be formed, thereby making it possible to achieve a reduction in NOx.

Further, with this construction, due to the provision of the guide portions 58, the combustion air can be converged and quickly brought into contact with the liquid fuel, so the combustion state of the flame approximates that of vaporizing combustion, making it possible to achieve a reduction in NOx. Further, by thus providing the guide portions 58 and enhancing the flow velocity of the jetted combustion air, the gas around the guide portions 58 is drawn (i.e., a state of self-recirculation is attained), so it is possible to achieve a reduction in NOx.

Further, the peripheral air jetting parts 47 constituting the burner 40 of this embodiment has the diffusing portions 59 as well as the guide portions 58 providing the various effects as mentioned above. As described above, the diffusing portions 59 are the portions of the through-hole portions 51 not covered with the guide portions 58 (see FIGS. 15 and 16). That is, the diffusing portions 59 are provided with no elements for rectifying the air flow such as the guide portions 58, so the air jetted from the diffusing portions 59 undergoes abrupt expansion at the edge portions of the diffusing portions 59 (edge portions of through-hole portions 51). Then, in the immediate vicinity of the burner 40, a little disturbance is generated in the air, making it possible to make partially uneven the way the liquid fuel sprayed from the nozzle part 42 is mixed with the air. Due to the provision of the diffusing portions 59, the burner 40 of this embodiment does not simply make the mixing condition satisfactory, but can intentionally attain a partially uneven mixing state. That is, in this embodiment, due to the provision of the diffusing portions 59, it is possible to attain a combustion state such as a thick and thin combustion state in the vicinity of burner 40, so it is possible to lower the gas temperature and to achieve a reduction in NOx value. Naturally, with this construction, the peripheral air jetting parts 47 have the diffusing portions 59, so the liquid fuel and the combustion air are mixed with each other effectively, thereby also making it possible to achieve a reduction in soot dust.

As described above, in the boiler 1 to which the burner 40 of this embodiment (see FIG. 15, etc.) is applied, it is possible to obtain a synergistic effect of a reduction in NOx, CO, and soot dust due to the suppression of expansion of the gas within the combustion chamber 16 of the boiler body 10, a reduction in gas temperature due to an appropriate exhaust gas circulation flow formed in the boiler body 10, a reduction in gas temperature due to the formation of an appropriate divisional flame, and a reduction in gas temperature due to a thick and thin combustion formed by the diffusing portions 59.

Further, while in the embodiment modes, etc. described above, the water tubes constituting the boiler body are provided with stud fins and plate-like fins as expansion heating surfaces, the present invention is not limited to this construction; the technical scope of the present invention also covers a construction in which each water tube is provided with a plurality of kinds of (e.g., in terms of configuration) plate-like fins. Thus, as a boiler according to another embodiment of the present invention, it is also possible to adopt a construction as shown, for example, in FIGS. 17, 18, and 19.

In this case, FIG. 17 is an explanatory longitudinal sectional view of a boiler according to another embodiment of the present invention; FIG. 18 is a schematic explanatory cross-sectional view (enlarged partial view) taken along the line Z1-Z1 of FIG. 17; and FIG. 19 is a schematic explanatory cross-sectional view (enlarged partial view) taken along the line Z2-Z2 of FIG. 17. The basic construction of the boiler of this embodiment is the same as that described in the third embodiment of the present invention, and the only difference lies in the structure of the fins provided on the water tubes. Thus, in the following, the portions that are the same as those of the third embodiment of the present invention are indicated by the same reference numerals, a detailed description thereof will be omitted, and the differences from the third embodiment of the present invention will be mainly described.

As shown in FIG. 17, etc., in the boiler of this embodiment, there are provided, on the lower portions of the water tubes 21 and 31, plate-like expansion heating surfaces (lower inner lateral fins 122 and lower outer lateral fins 132) inclined by 80 degrees with respect to the gas flow (vertical flow) (i.e., by 10 degrees with respect to the horizontal direction). On the upper portions of the water tubes 21 and 31, there are provided plate-like expansion heating surfaces (upper inner lateral fins 123 and upper outer lateral fins 133) inclined by 80 degrees with respect to the gas flow (vertical flow) (i.e., by 10 degrees with respect to the horizontal direction). That is, according to this embodiment, the fins 122 and 132 provided on the lower side and the fins 123 and 133 provided on the upper side are mounted to the water tubes 21 and 31 with the same angle (inclination angle).

As shown in FIG. 18, the lower inner lateral fins 122 (corresponding to the "expansion heating surfaces" of the present invention) are provided on the lower portions of the inner water tubes 21 constituting the boiler of this embodiment, and the lower outer lateral fins 132 (corresponding to the "expansion heating surfaces" of the present invention) are provided on the lower portions of the outer water tubes 31. The height of the lower inner lateral fins 122 and the lower outer lateral fins 132 of this embodiment is set to approximately 6 mm.

Further, as shown in FIG. 19, the upper inner lateral fins 123 (corresponding to the "plate-like fins" of the present invention) are provided on the upper portions of the inner water tubes 21 constituting the boiler of this embodiment, and the upper outer lateral fins 133 (corresponding to the "plate-like fins" of the present invention) are provided on the upper portions of the outer water tubes 31. In this case, slits (upper inner lateral fin slit portions 123A and upper outer lateral fin slit portions 133A) are provided in the forward end portions of the upper inner lateral fins 123 and the upper outer lateral fins 133, respectively. The height of the upper inner lateral fins 123 and the upper outer lateral fins 133 is set to approximately 12 mm.

As described above, in this embodiment, all the expansion heating surfaces are formed by plate-like fins (lateral fins), with the extension length from the outer peripheral surfaces of the water tubes of the lower fins (lateral fins) 122 and 132 being smaller than that of the upper fins (lateral fins) 123 and 133.

The boiler of this embodiment is constructed as described above, thus can provide the same effects as those of the embodiments described above. That is, even when the lateral fins 122 and 123 are provided instead of the stud fins, it is possible, by appropriately setting the height, etc. of the lateral fins 122 and 123, to withstand a predetermined thermal stress and perform effective heat recovery.

Further, according to this embodiment, the fins 122 and 132 provided on the lower side and the fins 123 and 133 provided on the upper side are mounted to the water tubes 21 and 31 with the same angle (inclination angle), so the requisite man-hours, etc. at the time of production are reduced, thus making it possible to enhance the production efficiency in boiler production.

While in the embodiment described above, the fins, 122, 123, 132, and 133 are provided on the water tubes 21 and 31 so as to be with an inclination angle of 80 degrees with respect to the gas flow (vertical flow) (i.e., at an inclination angle of 10 degrees with respect to the horizontal direction), the present invention is not limited to this construction. There are no particular limitations regarding the inclination angle as long as the fins provided on the lower side and the fins provided on the upper side are mounted to the water tubes with the same inclination angle. Thus, the technical scope of the present invention also covers, for example, a construction in which the fins 122 and 132 provided on the lower side and the fins 123 and 133 provided on the upper side are mounted to the water tubes 21 and 31 so as to be with an inclination angle of 40 degrees with respect to the gas flow (vertical flow) (i.e., at an inclination angle of 60 degrees with respect to the horizontal direction).

What is claimed is:

1. A boiler, comprising:

a boiler body having an inner water tube group and an outer water tube group that are arranged in an annular fashion; and a burner arranged at a central portion of the inner water tube group, wherein intervals between adjacent inner water tubes constituting the inner water tube group are closed except for portions where a gas flow passage is provided, the gas flow passage being located at one end of the inner water tube group at each interval between adjacent inner water tubes, and wherein expansion heating surfaces are plate-like fins or stud fins and are provided on a portion of at least one of the inner water tube group and the outer water tube group in a vicinity of the gas flow passage.

2. A boiler according to claim 1, wherein the expansion heating surfaces are provided on the portions of the inner water tube group and the outer water tube group in the vicinity of the gas flow passage, and wherein the outer water tube group is provided with more expansion heating surfaces than the inner water tube group.

3. A boiler according to claim 1, wherein the expansion heating surfaces are provided solely on the portion of the outer water tube group in the vicinity of the gas flow passage.

4. A boiler according to any one of claims 1 through 3, wherein the gas flow passage is provided in an annular fashion at one end of the inner water tube group.

5. A boiler according to any one of claims 1 through 3, wherein plate-like fins inclined with respect to a gas flow are provided on the downstream side of the expansion heating surfaces provided in the vicinity of the gas flow passage.

6. A boiler according to claim 5, wherein the plate-like fins are inclined by 20 to 85 degrees with respect to the gas flow.

* * * * *